US011846031B2

(12) United States Patent
Martic et al.

(10) Patent No.: US 11,846,031 B2
(45) Date of Patent: Dec. 19, 2023

(54) HYDROCARBON-SELECTIVE ELECTRODE

(71) Applicant: Siemens Energy Global GmbH & Co. KG, Munich (DE)

(72) Inventors: Nemanja Martic, Bayern (DE); Christian Reller, Minden (DE); Günter Schmid, Hemhofen (DE); Bernhard Schmid, Düren (DE); David Reinisch, Bayern (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 97 days.

(21) Appl. No.: 16/763,144

(22) PCT Filed: Nov. 16, 2018

(86) PCT No.: PCT/EP2018/081540
§ 371 (c)(1),
(2) Date: May 11, 2020

(87) PCT Pub. No.: WO2019/096985
PCT Pub. Date: May 23, 2019

(65) Prior Publication Data

US 2021/0172079 A1 Jun. 10, 2021

(30) Foreign Application Priority Data

Nov. 16, 2017 (DE) ..... 10 2017 220 450.8
Jul. 25, 2018 (DE) ..... 10 2018 212 409.4

(51) Int. Cl.
*C25B 11/077* (2021.01)
*C23C 24/02* (2006.01)
(Continued)

(52) U.S. Cl.
CPC ..... *C25B 11/077* (2021.01); *C23C 24/02* (2013.01); *C25B 3/25* (2021.01); *C25B 9/23* (2021.01);
(Continued)

(58) Field of Classification Search
CPC ..... C25B 11/077; C25B 11/093; C25B 11/031; C25B 11/032; C25B 11/052; C25B 3/25; C25B 3/26
See application file for complete search history.

(56) References Cited

U.S. PATENT DOCUMENTS 3,711,382 A * 1/1973 Anthony ..... C25B 11/0771 205/80
4,060,672 A * 11/1977 Alpen ..... H01M 8/10 429/304
(Continued)

FOREIGN PATENT DOCUMENTS

AU 2018300589 A1 12/2019
DE 102015201132 A1 7/2016
(Continued)

OTHER PUBLICATIONS

Eva M. Tejada-Rosales et al., Room-Temperature Synthesis and Crystal, Magnetic, and Electronic Structure of the First Silver Copper Oxide, Inorganic Chemistry 2002 41 (25), 6604-6613 (Year: 2002).*
(Continued)

*Primary Examiner* — Alexander W Keeling
*Assistant Examiner* — Mofoluwaso S Jebutu
(74) *Attorney, Agent, or Firm* — Wolter Van Dyke Davis, PLLC

(57) ABSTRACT

An electrode, which includes at least one tetragonally crystallized compound containing at least one element selected from the group of Cu and Ag, the crystal lattice of the
(Continued)

compound being of the space group $I4_1/amd$ type. An electrolysis cell includes the electrode.

15 Claims, 28 Drawing Sheets

(51) Int. Cl.

| | |
|---|---|
| ***C25B 3/25*** | (2021.01) |
| ***C25B 11/031*** | (2021.01) |
| ***C25B 11/093*** | (2021.01) |
| ***C25B 11/032*** | (2021.01) |
| ***C25B 11/054*** | (2021.01) |
| ***C25B 11/065*** | (2021.01) |
| ***C25B 9/23*** | (2021.01) |
| ***C25B 13/00*** | (2006.01) |

(52) U.S. Cl.

CPC ..... *C25B 11/031* (2021.01); *C25B 11/032* (2021.01); *C25B 11/054* (2021.01); *C25B 11/065* (2021.01); *C25B 11/093* (2021.01); *C25B 13/00* (2013.01)

(56) References Cited

U.S. PATENT DOCUMENTS

| | | | | |
|---|---|---|---|---|
| 5,998,057 | A | 12/1999 | Koschany et al. | |
| 9,481,939 | B2 | 11/2016 | Masel et al. | |
| 2003/0207174 | A1 | 11/2003 | Nanjundaswamy et al. | |
| 2006/0263232 | A1 | 11/2006 | Bulan | |
| 2013/0209897 | A1* | 8/2013 | Paranthaman | C01G 23/04 264/28 |
| 2013/0295439 | A1* | 11/2013 | Masarapu | H01M 4/131 429/188 |
| 2014/0346054 | A1* | 11/2014 | Sato | C25B 3/25 205/423 |
| 2017/0037522 | A1* | 2/2017 | Kaczur | C25B 9/19 |
| 2018/0044804 | A1* | 2/2018 | Hunter | C25B 11/051 |
| 2018/0127885 | A1 | 5/2018 | Krause et al. | |
| 2018/0195184 | A1 | 7/2018 | Fleischer et al. | |
| 2018/0230612 | A1 | 8/2018 | Krause et al. | |

FOREIGN PATENT DOCUMENTS

| | | | | |
|---|---|---|---|---|
| DE | 102015209509 | A1 | 11/2016 | |
| DE | 102015212504 | A1 | 1/2017 | |
| DE | 102015215309 | A1 | 2/2017 | |
| DE | 102017208610 | A1 | 11/2018 | |
| DE | 102017211930 | A1 | 1/2019 | |
| DE | 02015203245 | A1 | 12/2019 | |
| EP | 2918699 | A1 | 9/2015 | |
| JP | 2013143297 | A * | 7/2013 | |
| KR | 101774154 | B1 | 9/2017 | |
| WO | WO-2013047379 | A1 * | 4/2013 | H01M 10/052 |
| WO | 2017025285 | A1 | 2/2017 | |

OTHER PUBLICATIONS

Jorge Medina-Valtierra, Claudio Frausto-Reyes, Gabriela Camarillo-Martínez, Jorge A. Ramírez-Ortiz, Complete oxidation of isopropanol over Cu4O3 (paramelaconite) coating deposited on fiberglass by CVD, Applied Catalysis A: General, vol. 356, Issue 1, 2009, pp. 36-42, (Year: 2009).*

Ye, Zuo-Guang, Olivier Crottaz, François Vaudano, Frank Kubel, Paul Tissot, and Hans Schmid. Single crystal growth, structure refinement, ferroelastic domains and phase transitions of the hausmannite CuCr2O4.1994. Ferroelectrics 162, (1-4): 103-118 (Year: 1994).*

Lirun Zhao, Han Chen, Yingli Wang, Hongwei Che, Poernomo Gunawan, Ziyi Zhong, Hong Li, and Fabing Su, Facile Solvothermal Synthesis of Phase-Pure Cu4O3 Microspheres and Their Lithium Storage Properties, Chemistry of Materials 2012 24 (6), 1136-1142 (Year: 2012).*

C Petitjean, D Horwat and J F Pierson, Structure-properties relationship in reactively sputtered Ag—Cu—O films, 2009 J. Phys. D: Appl. Phys. 42 025304 (Year: 2009).*

Balagurov, A.M., Bobrikov, I.A., Maschenko, M.S. et al. Structural phase transition in CuFe2O4 spinel. Crystallogr. Rep. 58, 710-717 (2013) (Year: 2013).*

Sandra Hernandez-Aldave and Enrico Andreoli, Fundamentals of Gas Diffusion Electrodes and Electrolysers for Carbon Dioxide Utilisation: Challenges and Opportunities, Catalysts 2020, 10(6), 713 (Year: 2020).*

M. Le, M. Ren, Z. Zhang, P. T. Sprunger, R. L. Kurtz and J. C. Flake, Electrochemical Reduction of CO2 to CH3OH at Copper Oxide Surfaces, 2011 J. Electrochem. Soc. 158 E45 (Year: 2011).*

Chaosheng Xing , Yuan Zhang , Zhudong Wu , Deli Jiang and Min Chen, Ion-exchange synthesis of Ag/Ag2S/Ag3CuS2 ternary hollow microspheres with efficient visible-light photocatalytic activity, Dalton Trans., 2014,43, 2772-2780 (Year: 2014).*

L. Zhao et al.; Facile Solvothermal Synthesis of Phase-Pure Cu4O3 Microspheres and Their Lithium Storage Properties; Chem. Mater. 2012, 24, pp. 1136-1142; 2012.

Cook Ronald L et al: "High Rate Gas Phase Reduction to Ethylene and Methane Using Gas Diffusion Electrodes"; Journal of the Electrochemical Society, vol. 137; No. 2; pp. 607-608, XP055297363; US; ISSN: 0013-4651, DOI: 10.1149/1.2086515; 1990.

Reller, R. Krause, E. Volkova, B. Schmid, S. Neubauer, A. Rucki, M. Schuster, G. Schmid,; Adv. Energy Mater. 2017, 1602114 (DOI: 10.1002/aenm.201602114); 2017.

Hori Y: "Electrochemical CO2 Reduction on Metal Electrodes"; Modern Aspects of Electrochemistry, Springer, New York, 2008, pp. 89-189; 2008.

Tejada-Rosales, Eva M. et al: Room-temperature synthesis and crystal, magnetic, and Electronic structure of the first silver copper oxide; In: Inorganic Chemistry; VOI. 41;2002; No. 25; pp. 6604-6613. ; ISSN 0020-1669 (P); 1520-51 OX (E). DOI: 10.1021/ic025872b.

Le M. et al: "Electrochemical reduction of CO2 to CH30H at copper oxide surfaces", Journal of the Electrochemical Society, pp. E45, XP055547093, DOI: 10.1149/1.3561636; Gefunden im Internet: URL:http://citeseerx.ist.psu.edu/viewdoc/download?doi=10.1.1.1029.4196&rep=repl&type=pdf, Abstract pp.E47, right column; 2011.

Ohgushi K, et al., High-pressure synthesis and magnetic properties of orthorhombic , J. Phys. Soc. Jpn. 75 (023707) (2006) 1-3.

Database WPI Week 201769, Thomson Scientific, London, GB; AN 2017-662110, XP002788444, & KR 101 774 154 B1 (Univ Sejong Ind Acad Coop Found), Abstract; 2017.

PCT International Search Report and Written Opinion of International Searching Authority dated Feb. 20, 2019 corresponding PCT International Application No. PCT/EP2018/081540 filed Nov. 16, 2018.

* cited by examiner

HYDROCARBON-SELECTIVE ELECTRODE

CROSS REFERENCE TO RELATED APPLICATIONS

This application is the US National Stage of International Application No. PCT/EP2018/081540 filed 16 Nov. 2018, and claims the benefit thereof. The International Application claims the benefit of German Application No. DE 10 2017 220 450.8 filed 16 Nov. 2017 and German Application No. DE 10 2018 212 409.4 filed 25 Jul. 2018. All of the applications are incorporated by reference herein in their entirety.

FIELD OF INVENTION

The present invention relates to an electrode, to an electrolysis cell, to a process for producing an electrode, to a process for electrochemical conversion of $CO_2$ and/or CO using an electrode, to use of a compound for reduction or in the electrolysis of $CO_2$ and/or CO, and to use an electrode for reduction or in the electrolysis of $CO_2$ and/or CO.

BACKGROUND OF INVENTION

At present, about 80% of global energy demand is covered by the combustion of fossil fuels, the combustion processes of which cause global emission of about 34 000 million tonnes of carbon dioxide into the atmosphere per annum. This release into the atmosphere disposes of the majority of carbon dioxide, which can be up to 50 000 tonnes per day in the case of a brown coal power plant, for example. Carbon dioxide is one of the gases known as greenhouse gases, the adverse effects of which on the atmosphere and the climate are a matter of discussion. It is a technical challenge to produce products of value from $CO_2$. Since carbon dioxide is at a very low thermodynamic level, it can be reduced to reutilizable products only with difficulty, which has left the actual reutilization of carbon dioxide in the realm of theory or in the academic field to date.

Natural carbon dioxide degradation proceeds, for example, via photosynthesis. This involves conversion of carbon dioxide to carbohydrates in a process subdivided into many component steps over time and, at the molecular level, in terms of space. As such, this process cannot easily be adapted to the industrial scale. No copy of the natural photosynthesis process with photocatalysis on the industrial scale to date has had adequate efficiency.

An alternative is the electrochemical reduction of carbon dioxide. Systematic studies of the electrochemical reduction of carbon dioxide are still a relatively new field of development. Only in the last few years have there been efforts to develop an electrochemical system that can reduce an acceptable amount of carbon dioxide. Research on the laboratory scale has shown that electrolysis of carbon dioxide is preferably accomplished using metals as catalysts. For example, the publication "Electrochemical $CO_2$ reduction on metal electrodes by Y. Hori", published in: C. Vayenas, et al. (eds.), Modern Aspects of Electrochemistry, Springer, New York, 2008, p. 89-189, gives Faraday efficiencies at different metal cathodes which are listed in table 1 below, taken from this publication.

TABLE 1

Faraday efficiencies for the electrolysis of $CO_2$ to various products at various metal electrodes

| Electrode | $CH_4$ | $C_2H_4$ | $C_2H_5OH$ | $C_3H_7OH$ | CO | $HCOO^-$ | $H_2$ | Total |
|---|---|---|---|---|---|---|---|---|
| Cu | 33.3 | 25.5 | 5.7 | 3.0 | 1.3 | 9.4 | 20.5 | 103.5 |
| Au | 0.0 | 0.0 | 0.0 | 0.0 | 87.1 | 0.7 | 10.2 | 98.0 |
| Ag | 0.0 | 0.0 | 0.0 | 0.0 | 81.5 | 0.8 | 12.4 | 94.6 |
| Zn | 0.0 | 0.0 | 0.0 | 0.0 | 79.4 | 6.1 | 9.9 | 95.4 |
| Pd | 2.9 | 0.0 | 0.0 | 0.0 | 28.3 | 2.8 | 26.2 | 60.2 |
| Ga | 0.0 | 0.0 | 0.0 | 0.0 | 23.2 | 0.0 | 79.0 | 102.0 |
| Pb | 0.0 | 0.0 | 0.0 | 0.0 | 0.0 | 97.4 | 5.0 | 102.4 |
| Hg | 0.0 | 0.0 | 0.0 | 0.0 | 0.0 | 99.5 | 0.0 | 99.5 |
| In | 0.0 | 0.0 | 0.0 | 0.0 | 2.1 | 94.9 | 3.3 | 100.3 |
| Sn | 0.0 | 0.0 | 0.0 | 0.0 | 7.1 | 88.4 | 4.6 | 100.1 |
| Cd | 1.3 | 0.0 | 0.0 | 0.0 | 13.9 | 78.4 | 9.4 | 103.0 |
| Tl | 0.0 | 0.0 | 0.0 | 0.0 | 0.0 | 95.1 | 6.2 | 101.3 |
| Ni | 1.8 | 0.1 | 0.0 | 0.0 | 0.0 | 1.4 | 88.9 | 92.4 |
| Fe | 0.0 | 0.0 | 0.0 | 0.0 | 0.0 | 0.0 | 94.8 | 94.8 |
| Pt | 0.0 | 0.0 | 0.0 | 0.0 | 0.0 | 0.1 | 95.7 | 95.8 |
| Ti | 0.0 | 0.0 | 0.0 | 0.0 | 0.0 | 0.0 | 99.7 | 99.7 |

The table reports Faraday efficiencies [%] of products that form in the reduction of carbon dioxide at various metal electrodes. The values reported are applicable here to a 0.1 M potassium hydrogencarbonate solution as electrolyte and current densities below 10 mA/cm$^2$.

While carbon dioxide is reduced almost exclusively to carbon monoxide at silver, gold, zinc, palladium and gallium cathodes, for example, a multitude of hydrocarbons form as reaction products at a copper cathode.

For example, in an aqueous system, predominantly carbon monoxide and a little hydrogen would form at a silver cathode. The reactions at anode and cathode in that case can be represented by way of example by the following reaction equations:

$$\text{Cathode: } 2CO_2+4e^-+4H^+ \rightarrow 2CO+2H_2O$$

$$\text{Anode: } 2H_2O \rightarrow O_2+4H^++4e^-$$

Of particular economic interest, for example, is the electrochemical production of carbon monoxide, ethylene or alcohols.

Examples $$\text{Carbon monoxide: } CO_2+2e^-+H_2O \rightarrow CO+2OH^-$$

$$\text{Ethylene: } 2CO_2+12e^-+8H_2O \rightarrow C_2H_4+12OH^-$$

$$\text{Methane: } CO_2+8e^-+6H_2O \rightarrow CH_4+8OH^-$$

$$\text{Ethanol: } 2CO_2+12e^-+9H_2O \rightarrow C_2H_5OH+12OH^-$$

$$\text{Monoethylene glycol: } 2CO_2+10e^-+8H_2O \rightarrow HOC_2H_4OH+10OH^-$$

The reaction equations show that, for the production of ethylene from $CO_2$, for example, 12 electrons have to be transferred.

The stepwise reaction of $CO_2$ proceeds via a multitude of surface intermediates (—$CO_2$, —CO, =$CH_2$, —H). For each of these intermediates, there should preferably be a strong interaction with the catalyst surface or the active sites, such that a surface reaction (or further reaction) between the corresponding adsorbates is enabled. Product selectivity is thus directly dependent on the crystal surface or interaction thereof with the surface species. For example, an elevated ethylene selectivity has been shown by experiments on monocrystalline high-index surfaces of copper (Cu 711, 511) in Journal of Molecular Catalysis A Chemical 199(l): 39-47, 2003. Materials that have a high number of crystallographic levels or have surface defects likewise have elevated ethylene selectivities, as shown in C. Reller, R. Krause, E. Volkova, B. Schmid, S. Neubauer, A. Rucki, M. Schuster, G. Schmid, Adv. Energy Mater. 2017, 1602114 (DOI: 10.1002/aenm.201602114), and DE102015203245 A1.

There is thus a close relationship between the nanostructure of the catalyst material and the ethylene selectivity. As well as the property of selectively forming ethylene, the material should retain its product selectivity even at high conversion rates (current densities), i.e. the advantageous structure of the catalyst centers should be conserved. However, owing to high surface mobility of copper, for example, the defects or nanostructures generated typically do not have prolonged stability, and so, even after a short time (60 min), degradation of the electrocatalyst can be observed. As a result of the structural alteration, the material loses the propensity to form ethylene. Moreover, with voltage applied to structured surfaces, the potentials vary easily, such that certain intermediates are formed preferentially in a small area at certain points, and these can then react further at a slightly different point. As in-house studies have shown, potential variations well below 50 mV are significant.

Product selectivity with respect to hydrocarbons, for example ethylene, is dependent both on the morphology and on the chemical composition of the catalyst. For example, $Cu_2O$-based catalysts show elevated Faraday efficiency for ethylene compared to CuO or Cu. However, $Cu_2O$ is not chemically stable under negative potential; more particularly, it is not stable to reduction under operating conditions.

The prior art to date does not disclose any catalyst systems having prolonged stability that can electrochemically reduce $CO_2$ to hydrocarbons, such as ethylene, at high current density >100 mA/cm$^2$. Current densities of industrial relevance can be achieved using gas diffusion electrodes (GDEs). This is known from the existing prior art, for example, for chlor-alkali electrolyses implemented on the industrial scale.

Cu-based gas diffusion electrodes for production of hydrocarbons based on $CO_2$ are already known from the literature. The studies by R. Cook, J. Electrochem. Soc., vol. 137, no. 2, 1990, mention, for example, a wet-chemical method based on a PTFE 30B (suspension)/$Cu(OAc)_2$/Vulkan XC 72 mixture. The method states how, using three coating cycles, a hydrophobic conductive gas transport layer and, using three further coatings, a catalyst-containing layer are applied. Each layer is followed by a drying phase (325° C.) with a subsequent static pressing operation (1000-5000 psi). For the electrode obtained, a Faraday efficiency of >60% and a current density of >400 mA/cm$^2$ were reported. Reproduction experiments demonstrate that the static pressing method described does not lead to stable electrodes. An adverse effect of the Vulkan XC 72 included in the mixture was likewise found, and so likewise no hydrocarbons were obtained.

There is therefore still a need for efficient electrodes and electrolysis systems having prolonged stability for production of hydrocarbons, such as ethylene, from carbon dioxide and/or carbon monoxide.

SUMMARY OF INVENTION

One embodiment of the present invention relates to an electrode comprising at least one tetragonally crystallized compound containing at least one element selected from Cu and Ag, wherein the crystal lattice of the compound belongs to the $I4_1$/amd space group. More particularly, the electrode may comprise two or more of these compounds of different chemical composition.

The inventors have found that tetragonally crystallized compounds containing at least one element selected from Cu and Ag, wherein the crystal lattice of the respective compounds belongs to the $I4_1$/amd space group, are of excellent suitability as catalysts of prolonged stability for the reduction of carbon dioxide and/or carbon monoxide to hydrocarbons, such as ethylene, especially at high current densities (>200 mA/cm$^2$). These tetragonally crystallized compounds are also referred to here as catalyst.

Such tetragonally crystallized compounds have to date never been used or considered as catalysts for the electrochemical reduction of $CO_2$ and/or CO. In that respect, the invention also relates to use of one or more of these compounds as catalysts for the electrochemical reduction of $CO_2$ and/or CO. Furthermore, one or more of these compounds may also be present in the catalyst material as well as other constituents. It is also possible for one or more of these compounds to be used as pre-catalyst. In the production of the catalyst material, furthermore, formation of catalyst dendrites is possible, which can reduce overvoltages. More particularly, a gas diffusion electrode comprising at least one tetragonally crystallized compound containing at least one element selected from Cu and Ag, wherein the crystal lattice of the compound belongs to the $I4_1$/amd space group, is specified as electrode for $CO_2$ reduction and/or CO reduction, which exhibits high activity and high selectivity for hydrocarbons, especially for ethylene. The electrode is also particularly suitable for an electrochemical conversion in liquid electrolytes.

The at least one tetragonally crystallized compound present in the electrode of the abovementioned embodiment has a crystal lattice of the $I4_1$/amd space group. The compound may have crystallized at least partly in the $I4_1$/amd space group. There are different oxidation states in the compound, and these are stabilized by the lattice structure. Moreover, there are three-dimensional cavities in the form of tunnels in the lattice structure, which run essentially parallel to the lattice constants a and b. Oxygen species can be transported through this tunnel. Surprisingly, this lattice structure is conserved even when redox processes take place in the electrochemical reduction of $CO_2$. This has been determined by the inventors by measurements with an x-ray diffractometer (PXRD) on electrodes after $CO_2$ electrolysis, in which the starting phase of the tetragonally crystallized compound was present.

The inventors have also found that the electrode in embodiments of the invention, preferably gas diffusion electrodes or layers, preferably with at least 0.5 mg/cm$^2$ of the catalyst or catalyst combination, can have one or more of the following advantages in the electrochemical reduction of $CO_2$ and/or CO to hydrocarbons: — a higher selectivity for hydrocarbons, especially for ethylene, compared to Ag, Cu, $Cu_2O$ and/or CuO; —a higher stability at the reaction potential to reduction of the catalyst material; —superior activity compared to Ag, Cu, $Cu_2O$ and/or CuO; —a lower overvoltage for the reduction of $CO_2$ and/or CO to ethylene compared to Ag, Cu, $Cu_2O$ and/or CuO; and—high thermal stability of the catalyst up to 300° C. or higher.

When the electrode of embodiments, preferably gas diffusion electrodes or layers, preferably with at least 0.5 mg/cm$^2$ of the catalyst or catalyst combination, comprises a mixed Ag/Cu catalyst, especially one of the tetragonally crystallized compounds containing both Ag and Cu, the inventors have found one or more of the following advantageous effects in the electrochemical reduction of $CO_2$ compared to an Ag catalyst: —reduced selectivity for CO; —elevated selectivity for hydrocarbons, especially for ethylene, with rising current density; —reduced $H_2$ production; and—high activity at lower cathode potential.

The tetragonally crystallized compound may also be selected from $Cu_4O_3$ and a compound isomorphous with $Cu_4O_3$, especially a compound isomorphous with paramelaconite. It is possible here, in the crystal lattice of the compound isomorphous with $Cu_4O_3$ ($Cu^+_2Cu^{2+}_2O_3$), for at least one of lattice sites corresponding to the $Cu^+$ and the $Cu^{2+}$ to contain Cu or Ag or proportions of Cu or Ag. It is possible here for the compound isomorphous with $Cu_4O_3$ to be selected from $Ag_{0.58}CeSi_{1.42}$, $Ag_2Cu_2O_3$, $Ag_{0.28}Si_{1.72}Yb$, $Cu_{1.035}TeI$, $CuCr_2O_4$, $C_4H_4CuN_6$, $Ag_{0.7}CeSi_{1.3}$, $Ag_7O_4S_2Si$, $Ag_3CuS_2$, CuTeCl, $Ba_2Cs_2Cu_3F_{12}$, $CuO_4Rh_2$, $CuFe_2O_4$, $Ag_{0.3}CeSi_{1.7}$, $Ag_6O_8SSi$, $BaCuInF_7$, $Cu_{0.99}TeBr$, $BaCu_2O_2$, $Cu_{16}O_{14.15}$, $YBa_2Cu_3O_6$ and $C_8Ag_9Cl_6Cs_5N_8$. The electrode may comprise any combination of the tetragonally crystallized compounds mentioned. Use of one or more of these compounds in the electrode can achieve the above-described advantages in the electrochemical reduction of $CO_2$ and/or CO to hydrocarbons in a particularly comprehensive manner.

The electrode may contain the at least one tetragonally crystallized compound in an amount of 0.1-100% by weight, preferably 40-100% by weight, further preferably 70-100% by weight, based on the electrode or on a region of the electrode. This amount of the at least one tetragonally crystallized compound promotes the electrochemical reduction of $CO_2$ and/or CO to hydrocarbons.

In addition, the at least one tetragonally crystallized compound may have been applied to a support. The compound may especially have been applied here with a mass coverage of at least 0.5 mg/cm$^2$. The mass coverage may preferably be 1 to 10 mg/cm$^2$. In addition, the electrode may be a gas diffusion electrode. In this way, it is possible to achieve the advantages that are elucidated above particularly efficiently.

The invention further relates to an electrolysis cell comprising an electrode according to embodiments, preferably as cathode.

A further embodiment of the invention relates to a process for producing an electrode, especially an electrode according to embodiments, comprising—providing at least one tetragonally crystallized compound containing at least one element selected from Cu and Ag, wherein the crystal lattice of the compound belongs to the $I4_1/amd$ space group; and further comprising a step selected from: —applying the compound to a support; and—forming the compound to an electrode.

The process of the above embodiment enables the production of an electrode according to embodiments of the invention with the above-described advantages in the electrochemical reduction of $CO_2$ and/or CO to hydrocarbons.

In the process according to embodiments, the compound may be selected from $Cu_4O_3$ and a compound isomorphous with $Cu_4O_3$. It is possible here, in the crystal lattice of the compound isomorphous with $Cu_4O_3$ ($Cu^+_2Cu^{2+}_2O_3$), for at least one of the lattice sites corresponding to the $Cu^+$ and the $Cu^{2+}$ to contain Cu or Ag or proportions of Cu or Ag. It is possible here for the compound isomorphous with $Cu_4O_3$ to be selected from $Ag_{0.58}CeSi_{1.42}$, $Ag_2Cu_2O_3$, $Ag_{0.28}Si_{1.72}Yb$, $Cu_{1.035}TeI$, $CuCr_2O_4$, $C_4H_4CuN_6$, $Ag_{0.7}CeSi_{1.3}$, $Ag_8O_4S_2Si$, $Ag_3CuS_2$, CuTeCl, $Ba_2Cs_2Cu_3F_{12}$, $CuO_4Rh_2$, $CuFe_2O_4$, $Ag_{0.3}CeSi_{1.7}$, $Ag_6O_8SSi$, $BaCuInF_7$, $Cu_{0.99}TeBr$, $BaCu_2O_2$, $Cu_{16}O_{14.15}$, $YBa_2Cu_3O_6$ and $C_8Ag_8Cl_6Cs_5N_8$. More particularly, any combination of the tetragonally crystallized compounds mentioned can be provided and processed in the process.

The step of applying the compound to the support may be selected from—applying a mixture or powder comprising the compound to the support and dry rolling the mixture or powder onto the support; —applying a dispersion comprising the compound to the support; and—contacting the support with a gas phase comprising the compound, and applying the compound to the support from the gas phase.

In this way, it is possible to produce an electrode according to preferred embodiments with an electrolytically active catalyst layer present on the support. The layer thickness of the catalyst layer produced may be in the region of 10 nm or more, preferably 50 nm to 0.5 mm. The compound may be applied here with a mass coverage of at least 0.5 mg/cm$^2$. In addition, the rolling can be effected at a temperature of 25-100° C., preferably 60-80° C.

In embodiments of the process in which the compound is applied to a support, this may be a gas diffusion electrode, a support of a gas diffusion electrode or a gas diffusion layer.

In the process according to the above-described embodiment in which an electrode is formed, the step of forming the compound to an electrode may comprise rolling a powder comprising the compound to give the electrode. In addition, it is possible to form a mixture comprising the compound to give the electrode, where the mixture may be pulverulent or may contain a liquid.

In addition, it is possible in the process of embodiments to produce the electrode in such a way that the compound is present in an amount of 0.1-100% by weight, preferably 40-100% by weight, further preferably 70-100% by weight, based on the electrode or on a region of the electrode. This amount of the at least one tetragonally crystallized compound promotes the electrochemical reduction of $CO_2$ and/or CO to hydrocarbons.

In addition, in the process according to embodiments, the compound may be provided and applied or formed in a mixture comprising at least one binder, preferably also an ionomer. Use of a binder can achieve suitable adjustment of pores or channels of the electrode layer or electrode formed that promote the electrochemical conversion of $CO_2$ and/or CO.

It is possible here for the at least one binder to be present in the mixture in an amount of >0% to 30% by weight, based on the total weight of the compound and the at least one binder.

One embodiment of the invention further relates to a process for electrochemical conversion of $CO_2$ and/or CO, wherein $CO_2$ and/or CO is introduced at the cathode into an electrolysis cell comprising an electrode according to embodiments of the invention as cathode and reduced.

A further embodiment of the invention is directed to use of at least one tetragonally crystallized compound containing at least one element selected from Cu and Ag, wherein the crystal lattice of the compound belongs to the $I4_1/amd$ space group, for reduction or in the electrolysis of $CO_2$ and/or CO.

Another embodiment relates to use of an electrode according to embodiments for reduction or in the electrolysis of $CO_2$ and/or CO.

Further features and advantages of the invention can be taken from the detailed description of working examples that follows, these being elucidated in detail in association with the drawings that follow.

BRIEF DESCRIPTION OF THE DRAWINGS

The appended drawings, in association with the description, serve more particularly to elucidate concepts and principles of the invention. Other embodiments and many of the advantages mentioned are apparent with regard to the drawings. The elements of the drawings are not necessarily shown true to scale with respect to one another. Elements, features and components that are the same, have the same function and the same effect are each given the same reference numerals in the figures of the drawings, unless stated otherwise. The drawings show.

DETAILED DESCRIPTION OF THE INVENTION

Figure 1:
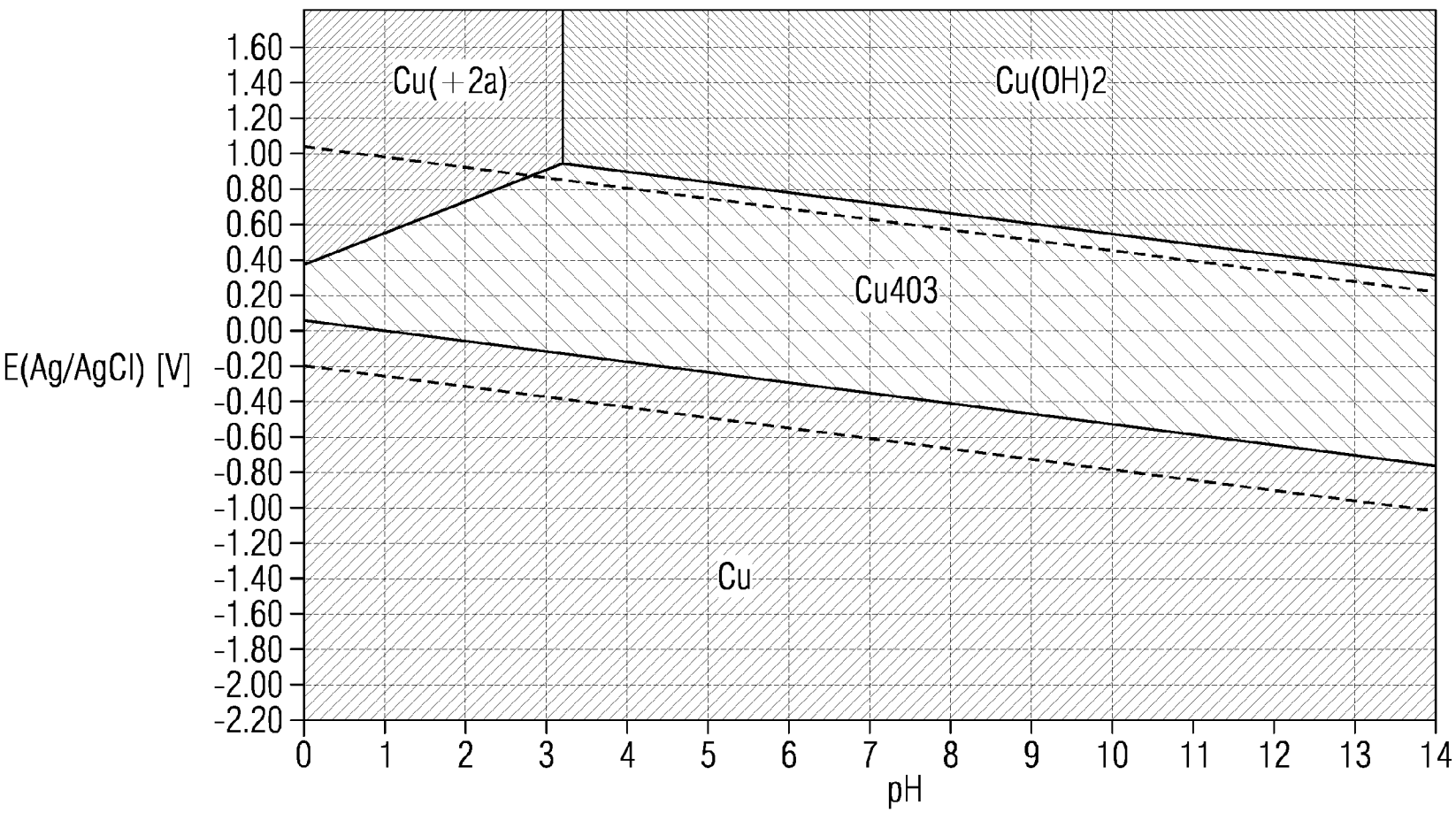
FIG. 1 the Pourbaix diagram of copper.

Unless defined differently, technical and scientific expressions used herein have the same meaning as commonly understood by a person skilled in the art in the specialist field of the invention.

An electrode is an electrical conductor that can supply electrical current to a liquid, a gas, vacuum or a solid body. More particularly, an electrode is not a powder or a particle, but may comprise particles and/or a powder or be produced from a powder. A cathode here is an electrode at which an electrochemical reduction can take place, and an anode is an electrode at which an electrochemical oxidation can take place. In particular embodiments, the electrochemical conversion takes place here in the presence of preferably aqueous electrolytes.

Stated amounts in the context of the present invention are based on % by weight, unless stated otherwise or apparent from the context. In the material of the catalytically active region, for example of a layer, of an electrode or gas diffusion electrode according to embodiments of the invention, the percentages by weight may add up to 100% by weight.

In the context of the present invention, "hydrophobic" is understood to mean water-repellent. Hydrophobic pores and/or channels, in embodiments of the invention, are thus those that repel water. More particularly, hydrophobic properties may be associated with substances or molecules having nonpolar groups.

By contrast, "hydrophilic" is understood to mean the ability to interact with water and other polar substances.

In the context of the present invention, the term "paramelaconite" is understood to mean naturally occurring and synthetically produced $Cu_4O_3$. In embodiments of the invention, preference is given to using synthetically produced $Cu_4O_3$.

One embodiment of the present invention relates to an electrode comprising at least one tetragonally crystallized compound containing at least one element selected from Cu and Ag, wherein the crystal lattice of the compound belongs to the $I4_1/amd$ space group. More particularly, the electrode may comprise two or more of these compounds of different chemical composition. The compounds are centrosymmetric at room temperature. The tetragonally crystallized compound serves as catalyst in the electrode and surprisingly leads to one or more of the advantageous effects described above, especially in the reduction of carbon dioxide and/or carbon monoxide to hydrocarbons, such as ethylene or ethanol.

The tetragonally crystallized compound may be selected from $Cu_4O_3$ and a compound isomorphous with $Cu_4O_3$, especially a compound isomorphous with paramelaconite. It is possible here, in the crystal lattice of the compound isomorphous with $Cu_4O_3$ ($Cu^+{}_2Cu^{2+}{}_2O_3$), for at least one of the lattice sites corresponding to the $Cu^+$ and the $Cu^{2+}$ to contain Cu or Ag or proportions of Cu or Ag. This compound isomorphous with $Cu_4O_3$ may be selected from $Ag_{0.58}CeSi_{1.42}$, $Ag_2Cu_2O_3$, $Ag_{0.28}Si_{1.72}Yb$, $Cu_{1.035}TeI$, $CuCr_2O_4$, $C_4H_4CuN_6$, $Ag_{0.7}CeSi_{1.3}$, $Ag_8O_4S_2Si$, $Ag_3CuS_2$, CuTeCl, $Ba_2Cs_2Cu_3F_{12}$, $CuO_4Rh_2$, $CuFe_2O_4$, $Ag_{0.3}CeSi_{1.7}$, $Ag_6O_8SSi$, $BaCuInF_7$, $Cu_{0.99}TeBr$, $BaCu_2O_2$, $Cu_{16}O_{14.15}$, $YBa_2Cu_3O_6$ and $C_8Ag_9Cl_6Cs_5N_8$. The electrode may comprise any combination of the tetragonally crystallized compounds mentioned. Use of one or more of these compounds in the electrode can achieve the advantages described above in the electrochemical reduction of $CO_2$ and/or CO to hydrocarbons in a particularly comprehensive manner.

In embodiments, in the crystal lattice of the compound isomorphous with $Cu_4O_3$ ($Cu^+{}_2Cu^{2+}{}_2O_3$), proceeding from $Cu_4O_3$, the $Cu^+$ lattice site may be wholly or partly replaced by another atom. The same may alternatively or additionally apply to the $Cu^{2+}$ lattice site. The charge of the atom present wholly or partly at the $Cu^+/Cu^{2+}$ lattice site may differ here from that of the $Cu^+$ or $Cu^{2+}$. At least one of lattice sites corresponding to $Cu^+$ or $Cu^{2+}$ may contain Cu or Ag or proportions thereof. The charge can be compensated for by monovalent, divalent or trivalent anions.

One embodiment of the invention relates to an electrode comprising $Cu_4O_3$ and/or $Ag_2Cu_2O_3$.

Figure 2:
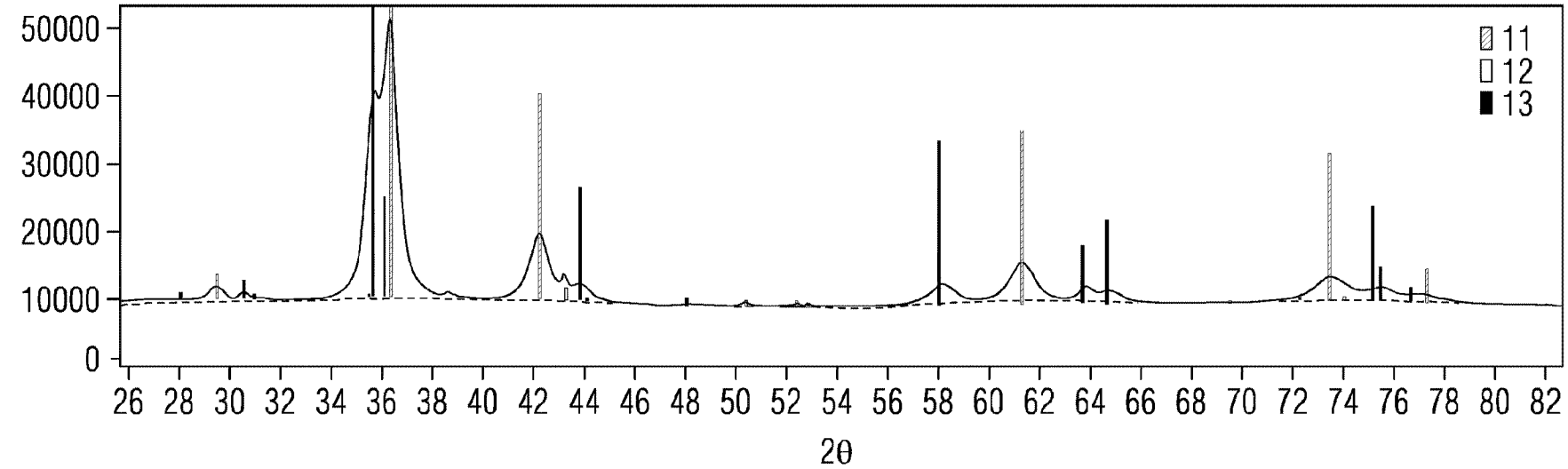
FIG. 2 a measured x-ray powder diffractogram of $Cu_4O_3$.

There follows a description by way of example of the compounds $Cu_4O_3$, $Ag_2Cu_2O_3$, $Ag_3CuS_2$, $Ag_8O_4S_2Si$, $CuO_4Rh_2$, $CuCr_2O_4$, and $BaCu_2O_2$ with reference to FIGS. 1 to 8. FIGS. 1 and 2 relate to $Cu_4O_3$, with FIG. 1 showing the Pourbaix diagram for copper and FIG. 2 a measured x-ray powder diffractogram of $Cu_4O_3$. FIGS. 3 to 8 each show a simulated x-ray powder diffractogram of $Ag_2Cu_2O_3$, $Ag_3CuS_2$, $Ag_8O_4S_2Si$, $CuO_4Rh_2$, $CuCr_2O_4$, and $BaCu_2O_2$ in that sequence.

$Cu_4O_3$, also called paramelaconite here, is a mixed-valency oxide having equal proportions of mono- and divalent Cu ions and is therefore sometimes also summarized formally as $Cu^+{}_2Cu^{2+}{}_2O_3$ or $Cu^+{}_2O\cdot(Cu^{2+}\ O)_2$. The crystal structure (space group $I4_1/amd$) of paramelaconite was identified as tetragonal, consisting of interpenetrating chains of $Cu^+$—O and $Cu^{2+}$—O. The $Cu^{2+}$ ions are coordinated to two $O^{2-}$ ions, while the $Cu^+$ ions are coordinated in a planar manner to four $O^{2-}$ ions. Paramelaconite is thermodynamically stable below 300° C.; at temperatures above 300° C., it breaks down to CuO and $Cu_2O$.

The electrochemical stability of paramelaconite is shown in the Pourbaix diagram of FIG. 1. The diagram shows the higher electrochemical stability of $Cu_4O_3$ to reduction by comparison with $Cu_2O$. As apparent from the diagram, a preferred operating range of electrodes with paramelaconite is at a pH between 6 and 14, preferably between 10 and 14. An x-ray powder diffractogram of $Cu_4O_3$ is shown in FIG. 2. The x-ray powder diffractograms shown here were recorded with a Bruker D2 PHASER diffractometer using CuK radiation at a scan rate of 0.02° $s^{-1}$.

In 2012, Zhao et al. in Zhao et al., Facile Solvothermal Synthesis of Phase-Pure $Cu_4O_3$ Microspheres and Their Lithium Storage Properties, Chem. Mater. 2012, 24, pages 1136-1142, described the synthesis of single-phase paramelaconite microspheres by a simple solvothermal method. The $Cu_4O_3$ microspheres were obtained by reacting the copper(II) nitrate trihydrate precursor ($Cu(NO_3)_2 \cdot 3H_2O$) in a mixed solvent composed of ethanol and N,N-dimethylformamide (DMF). The reaction was conducted in a 50 mL Teflon-lined stainless steel autoclave at 130° C. over several hours. As described in the examples, the inventors, by a synthesis following the route of Zhao et al., were able to increase the reaction volume to 1.1 L and increase the yield to more than 10 g.

Figure 3:
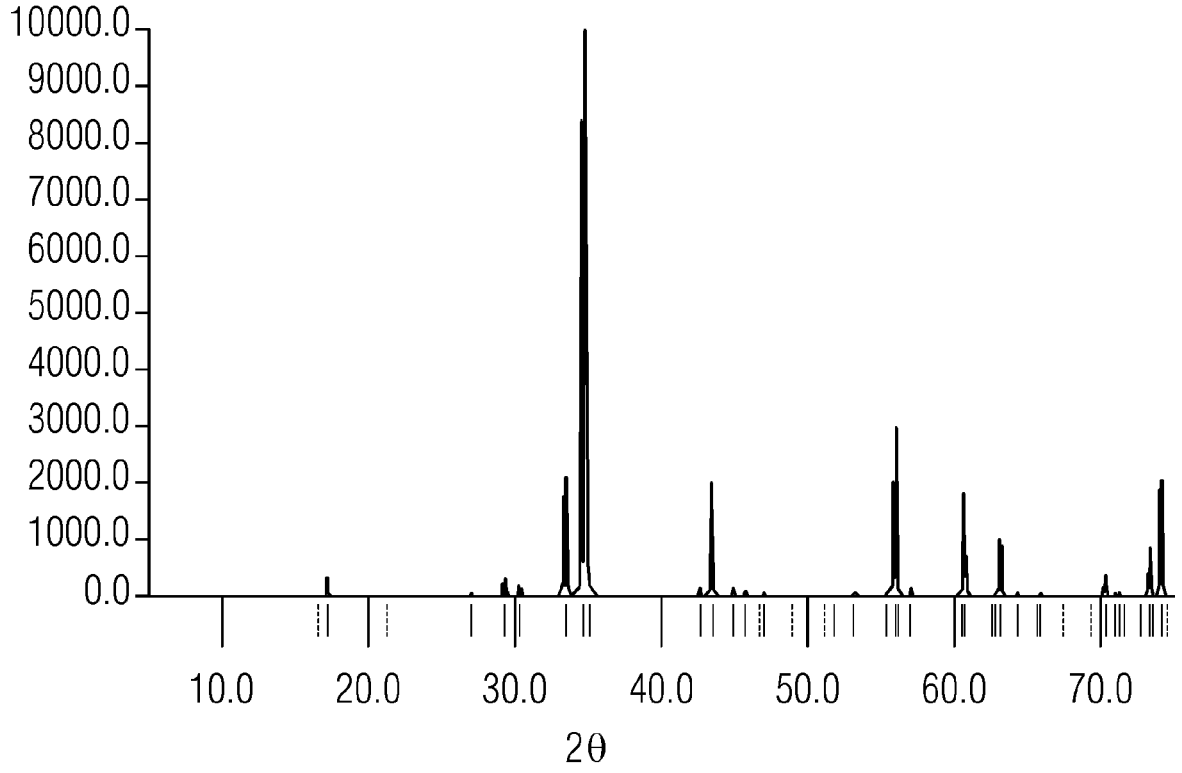
FIGS. 3 to 8 in each case a simulated x-ray powder diffractogram of $Ag_2Cu_2O_3$, $Ag_3CuS_2$, $Ag_8O_4S_2Si$, $CuO_4Rh_2$, $CuCr_2O_4$, and $BaCu_2O_2$ in that sequence.

The compound $Ag_2Cu_2O_3$, the x-ray diffractogram of which is shown in FIG. 3, consists of silver(I) and copper(II) ions. The structure includes two different oxygen species (O1 and O2) with a ratio of 1:2. The oxygen species 01 is present in a tetrahedral environment of four copper(II) ions. The oxygen species 02 is surrounded tetrahedrally by two Ag+ ions and two Cu2+ ions. It crystallizes in a tetragonal structure with the I41/amd space group. The lattice constants are a=b 0.5886 nm and c=1.0689 nm (CC=51672, ICSD). The crystal lattice contains an extended network of three-dimensional tunnels through which oxygen species and ions can be transported. The transport of oxygen through the tunnel enables a change in the oxidation states from Ag1+ to Ag3+ and Cu2+ to Cu1+ without the lattice structure collapsing. The direct band gap is 2.2 eV.

Figure 4:
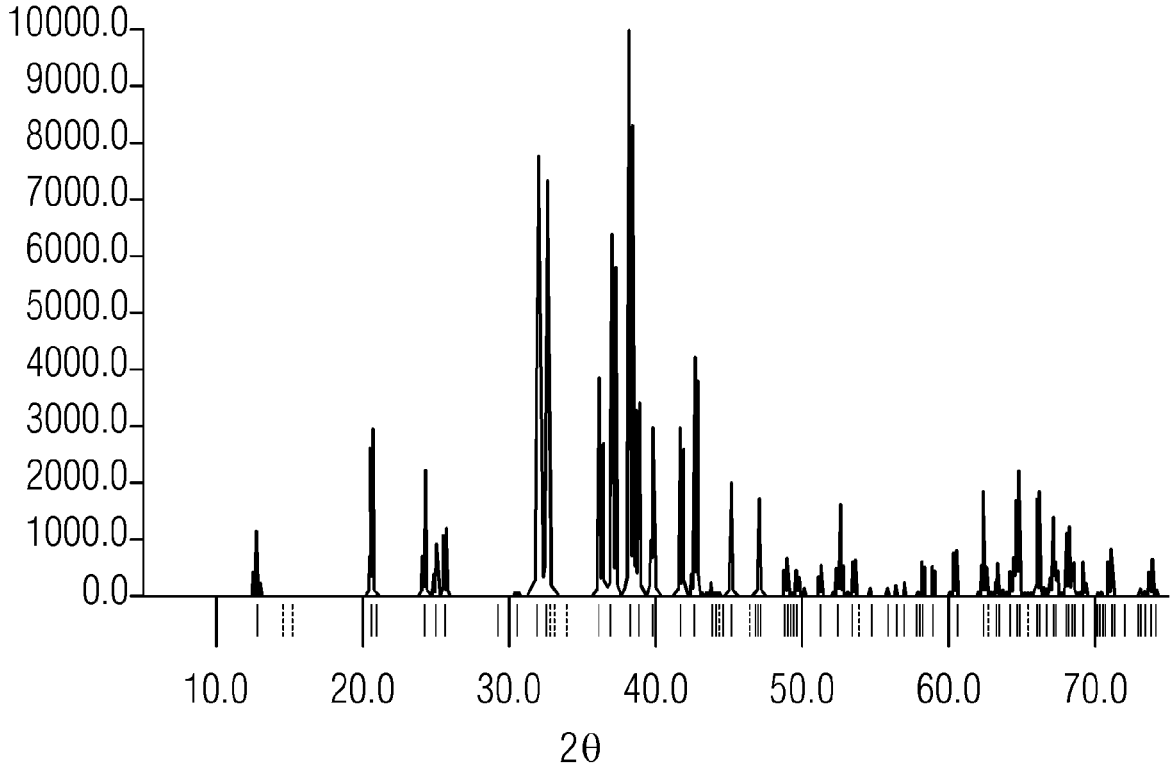
Figure 5:
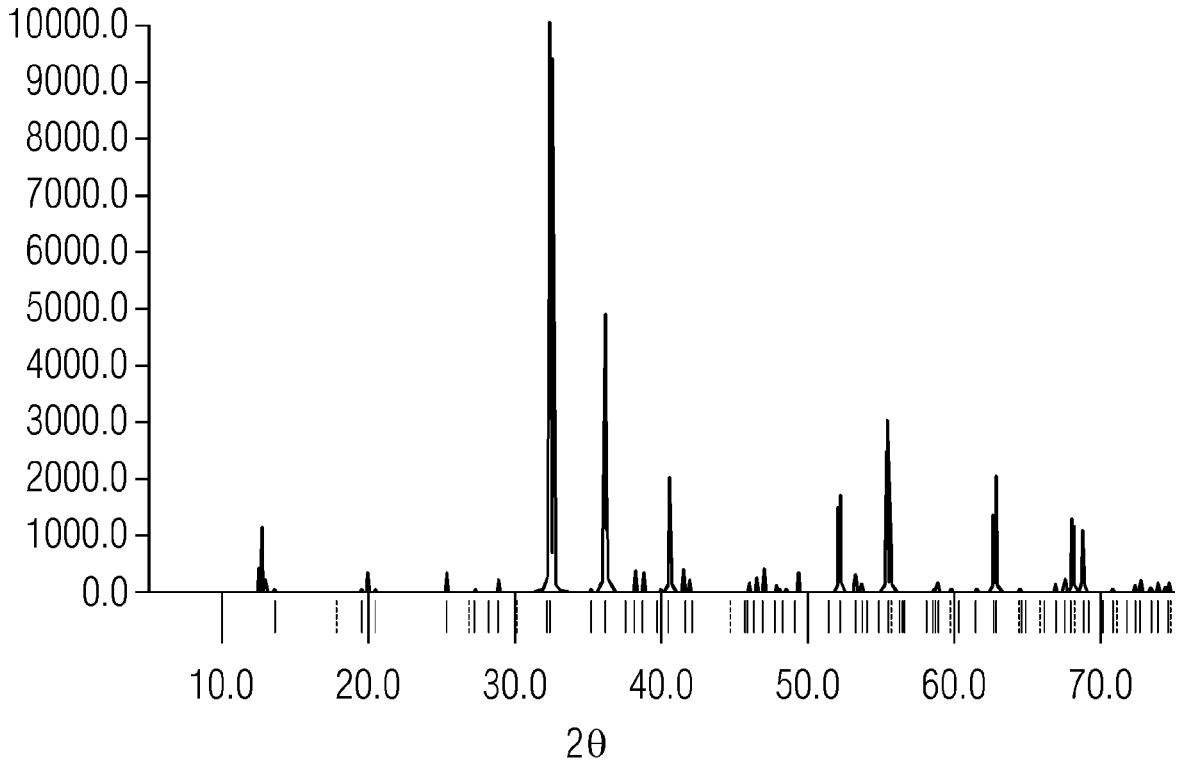
Figure 6:
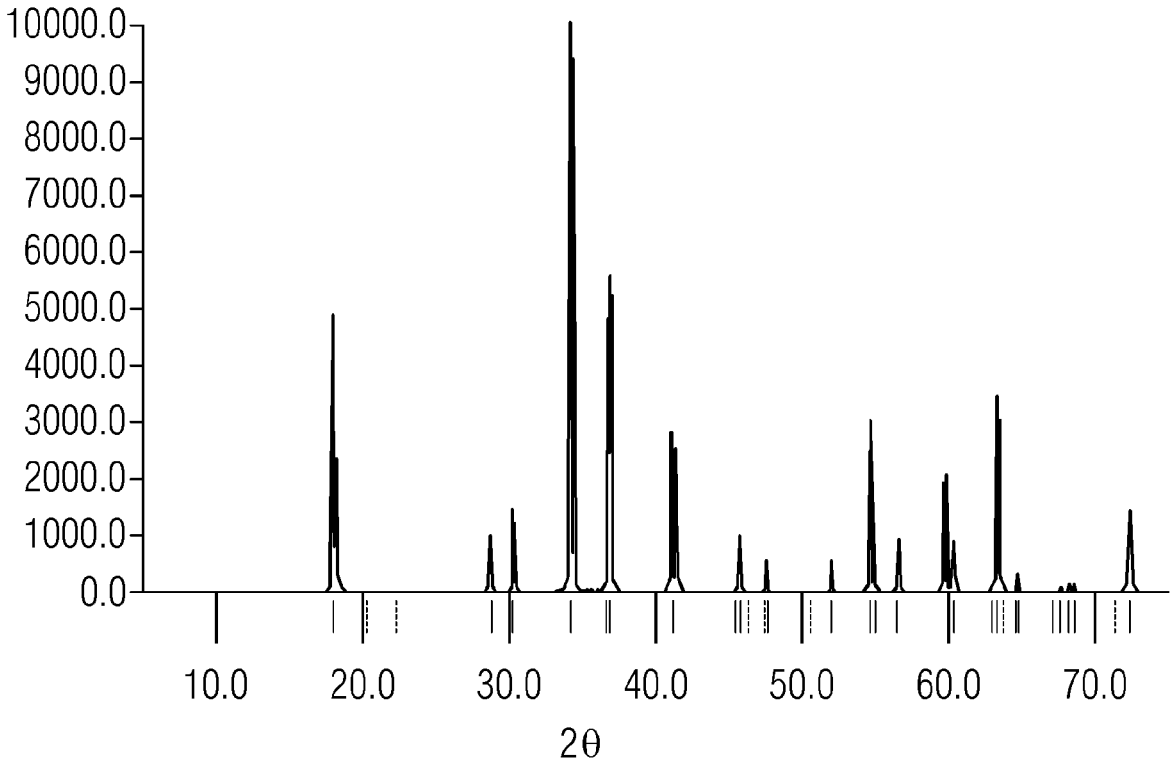
Figure 7:
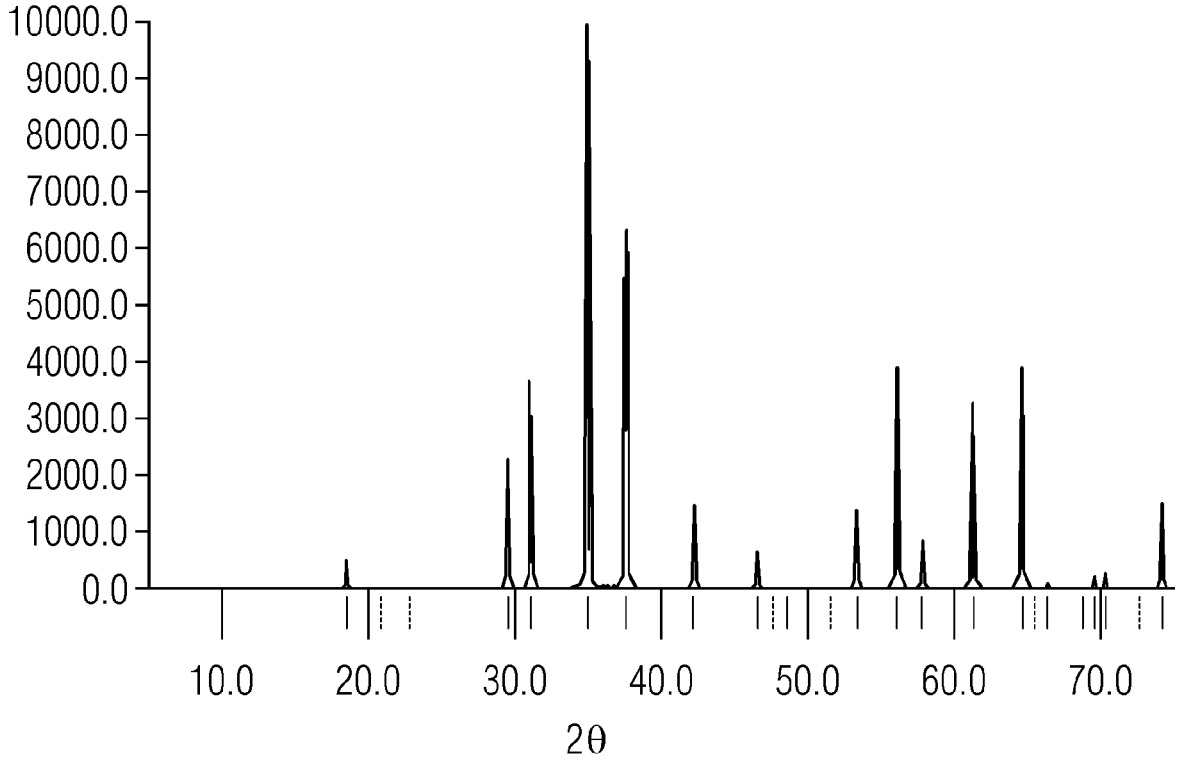
Figure 8:
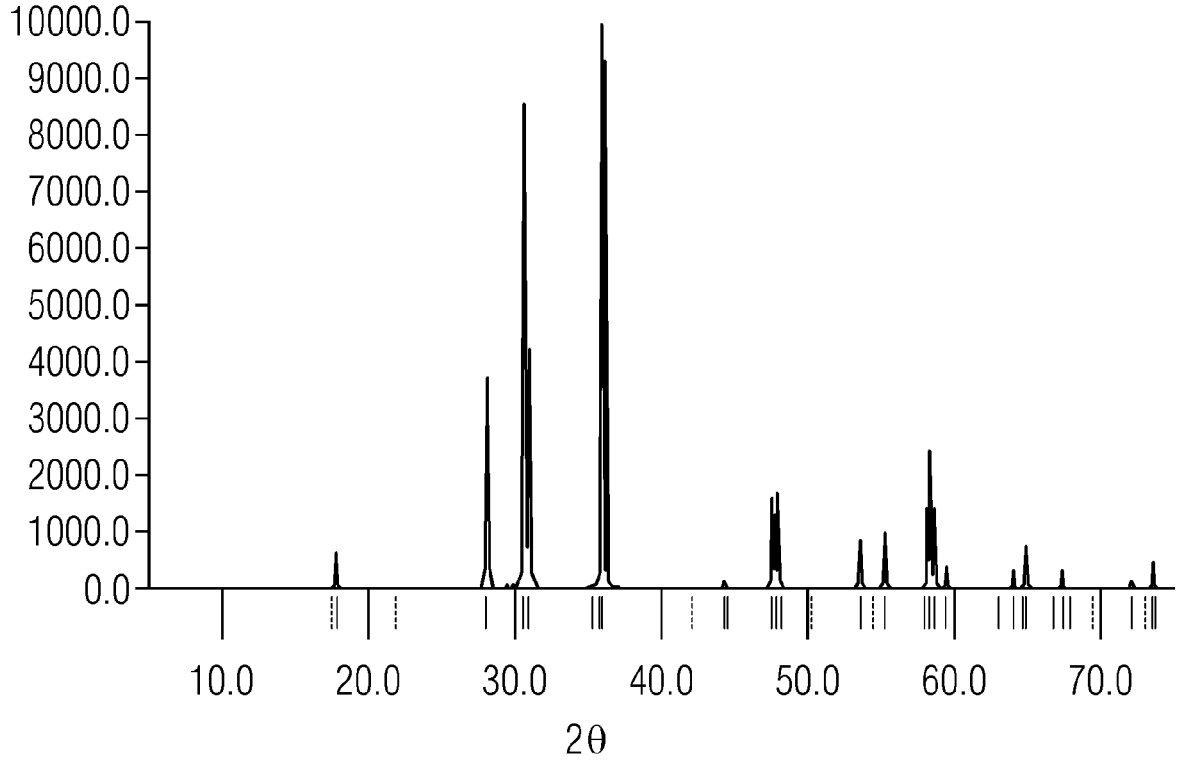

FIG. 4 shows the simulated x-ray diffractogram of $Ag_3CuS_2$. The mineral jalpaite having the same empirical formula exists in the $I4_1$/amd space group at 25° C. and has marked ion conductivity. FIG. 5 shows the simulated x-ray diffractogram of $Ag_3O_4S_2Si$. FIG. 6 shows the simulated x-ray diffractogram of $CuO_4Rh_2$. $CuO_4Rh_2$ was synthesized by pelletizing $Rh_2O_3$ and CuO and heating them in an evacuated quartz ampoule at 1073 K for 24 h (according to Ohgushi K., Gotou H., Yagi T., Ueda Y.: High-pressure synthesis and magnetic properties of orthorombic $CuRh_2O_4$; J. Phys. Soc. Jpn. 75(023707) (2006) 1-3). FIG. 7 shows the simulated x-ray diffractogram of $CuCr_2O_4$. FIG. 8 shows the simulated x-ray diffractogram of $BaCu_2O_2$.

The crystal lattices of all compounds crystallized tetragonally in the $I4_1$/amd space group that are used in embodiments of the invention each contain an extended network of three-dimensional tunnels through which oxygen species can be transported. This enables a change in the oxidation states without the lattice structure collapsing. In the inventors' view, this property is a reason why the compounds have surprisingly been found to be extremely advantageous for use as catalysts, especially in the electrolysis of $CO_2$ and/or CO.

In the electrode of embodiments of the invention, the amount of the tetragonally crystallized compound of the $I4_1$/amd space group is unlimited. In particular embodiments, the compound is present in an amount of 0.1-100% by weight, preferably 40-100% by weight, further preferably 70-100% by weight, based on the electrode. In further embodiments, the compound is present in an amount of 0.1-100% by weight, preferably 40-100% by weight, further preferably 70-100% by weight, based on the catalytically active part of the electrode, for example in a layer of the electrode, for example when the electrode is in multilayer form, for example with a gas diffusion layer, and/or in the form of a gas diffusion electrode.

In particular embodiments, the tetragonally crystallized compound of the $I4_1$/amd space group has been applied to a support which is not particularly restricted, either with regard to the material or to the configuration. A support here may, for example, be a compact solid-state body, for example in the form of a pin or strip, for example a metal strip. The compact solid-state body may, for example, comprise or consist of a metal such as Cu or an alloy thereof. In addition, the support may be a porous structure, for example a sheetlike structure, such as a mesh or a knit, or a coated body. The support may also, for example, take the form of a gas diffusion electrode, optionally also with multiple, for example 2, 3, 4, 5, 6 or more, layers, made of a suitable material, or of a gas diffusion layer on a suitable substrate, which is likewise not particularly restricted and may likewise comprise multiple layers, for example 2, 3, 4, 5, 6 or more. The gas diffusion electrode or gas diffusion layer used may correspondingly also be a commercially available electrode or layer. The material of the support is preferably conductive and comprises, for example, a metal and/or an alloy thereof, a ceramic, for example ITO, an inorganic nonmetallic conductor such as carbon and/or an ion-conductive or electrically conductive polymer.

It is also possible to use the tetragonally crystallized compound of the $I4_1$/amd space group in the production of gas diffusion layers or gas diffusion electrodes. Thus, an electrode in particular embodiments is a gas diffusion electrode or an electrode comprising a gas diffusion layer, wherein the gas diffusion electrode or the gas diffusion layer contains or even consists of the tetragonally crystallized compound of the $I4_1$/amd space group. When a gas diffusion layer comprising the tetragonally crystallized compound of the $I4_1$/amd space group is present, this may have been applied to a porous or nonporous substrate.

When the tetragonally crystallized compound of the $I4_1$/amd space group has been applied to a support, in particular embodiments, it has been applied with a mass coverage of at least 0.5 mg/$cm^2$. The application here is preferably not two-dimensional, in order to provide a greater active surface area. Moreover, the application preferably forms pores, or pores in the support are essentially not closed, such that a gas such as carbon dioxide can easily reach the compound. In particular embodiments, the compound has been applied with a mass coverage between 0.5 and 20 mg/$cm^2$, preferably between 0.8 and 15 mg/$cm^2$, further preferably between 1 and 10 mg/$cm^2$. Proceeding from these values, the amount of the tetragonally crystallized compound of the $I4_1$/amd space group as catalyst may be suitably determined for application to a particular support.

The inventors have found more particularly that embodiments of the gas diffusion electrode, especially gas diffusion electrodes or layers preferably having at least 1 mg/$cm^2$ of the tetragonally crystallized compound of the $I4_1$/amd space group, can have one or more of the following advantages in the electrochemical reduction of $CO_2$ and/or CO to hydrocarbons: —a higher selectivity for hydrocarbons, especially for ethylene, compared to Ag, Cu, $Cu_2O$ and/or CuO; —a higher stability at the reaction potential to reduction to Ag or Cu; —superior activity compared to Ag, Cu, $Cu_2O$ and/or CuO; and—a lower overvoltage for the reduction of $CO_2$ to ethylene compared to Ag, Cu, $Cu_2O$ and/or CuO.

When the electrode of embodiments, preferably embodiments of gas diffusion electrodes or layers, preferably having at least 0.5 mg/cm$^2$ of the catalyst or catalyst combination, comprises a mixed Ag/Cu catalyst, especially one of the tetragonally crystallized compounds containing both Ag and Cu, the inventors have especially found one or more of the following advantageous effects in the electrochemical reduction of $CO_2$ by comparison with an Ag catalyst: —reduced selectivity for CO; —elevated selectivity for hydrocarbons, especially for ethylene, with rising current density; —reduced $H_2$ production; and—high activity at lower cathode potential.

In particular embodiments, the electrode is a gas diffusion electrode which is not particularly restricted and may be in single- or multilayer form, for example with 2, 3, 4, 5, 6 or more layers. In such a multilayer gas diffusion electrode, it is then possible, for example, for the tetragonally crystallized compound of the $I4_1$/amd space group also to be present solely in one layer or not in all layers, i.e., for example, to form one or more gas diffusion layers. Especially with a gas diffusion electrode, good contacting with a gas comprising $CO_2$ and/or CO or consisting essentially of $CO_2$ and/or CO is very efficiently possible, such that efficient electrochemical preparation of $C_2H_4$ can be achieved here. Furthermore, this can alternatively be brought about with an electrode comprising a gas diffusion layer comprising or consisting of the tetragonally crystallized compound of the $I4_1$/amd space group, since a large reaction area can also be offered here to such a gas.

In embodiments, the following parameters and properties of a hydrocarbon-selective gas diffusion electrode or gas diffusion layer have been found to be favorable individually or in combination:

- Good wettability of the electrode surface in order that an aqueous electrolyte can come into contact with catalyst.
- High electrical conductivity of the electrode or of the catalyst and a homogeneous potential distribution over the entire electrode area (potential-dependent product selectivity).
- High chemical and mechanical stability in electrolysis operation (suppression of cracking and corrosion).
- The ratio between hydrophilic and hydrophobic pore volume is preferably in the region of about (0.01-1):3, further preferably approximately in the region of (0.1-0.5):3 and preferably about 0.2:3.
- Defined porosity with a suitable ratio between hydrophilic and hydrophobic channels or pores.

Average pore sizes in the range from 0.2 to 7 μm, preferably in the range from 0.4 to 5 μm and more preferably in the range from 0.5 to 2 μm have also been found to be advantageous in a gas diffusion electrode or a gas diffusion layer according to embodiments.

In particular embodiments, the electrode contains particles comprising or consisting of the tetragonally crystallized compound of the $I4_1$/amd space group, for example $Cu_4O_3$ particles. For example, these particles are used to produce the electrode of embodiments of the invention, especially a gas diffusion electrode, or a gas diffusion layer. The particles used or present in the electrode may have an essentially uniform particle size, for example between 0.01 and 100 μm, for example between 0.05 and 80 μm, preferably 0.08 to 10 μm, further preferably between 0.1 and 5 μm, for example between 0.5 and 1 μm. In addition, the catalyst particles in particular embodiments also have a suitable electrical conductivity, especially a high electrical conductivity a of $>10^3$ S/m, preferably $10^4$ S/m or more, further preferably $10^5$ S/m or more, especially $10^6$ S/m or more. It is optionally possible here to add suitable additives, for example metal particles, in order to increase the conductivity of the particles. Moreover, the catalyst particles in particular embodiments have a low overvoltage for the electroreduction of $CO_2$ and/or CO. In addition, the catalyst particles in particular embodiments have high purity without extraneous metal traces. By suitable structuring, optionally with the aid of promoters and/or additives, it is possible to achieve high selectivity and prolonged stability.

For a particularly good catalytic activity, a gas diffusion electrode or an electrode with a gas diffusion layer in embodiments may have hydrophilic and hydrophobic regions that enable a good relationship between the three phases: liquid, solid, gaseous. Particularly active catalyst sites are in the three-phase region of liquid, solid, gaseous. The gas diffusion electrode of particular embodiments thus has penetration of the bulk material with hydrophilic and hydrophobic channels in order to obtain a maximum number of three-phase regions for active catalyst sites. The same applies to the gas diffusion layer in embodiments.

Hydrocarbon-selective gas diffusion electrodes and gas diffusion layers of embodiments may accordingly have multiple intrinsic properties. There may be a close interplay between the electrocatalyst and the electrode.

The electrode of embodiments may, as well as the tetragonally crystallized compound of the $I4_1$/amd space group, comprise further constituents such as promoters, conductivity additives, cocatalysts and/or binding agents/binders. In the context of the present invention, the terms binding agent and binder are used as synonymous words with the same meaning. For example, as stated above, additives may be added to increase the conductivity, in order to enable good electrical and/or ionic contacting of the tetragonally crystallized compound of the $I4_1$/amd space group. Cocatalysts may optionally catalyze, for example, the formation of further products from ethylene and/or else the formation of intermediates in the electrochemical reduction of $CO_2$ to ethylene. The cocatalysts may alternatively optionally catalyze completely different reactions, for example when a reactant other than $CO_2$ is used in an electrochemical reaction, for example an electrolysis.

The electrode of embodiments, especially a gas diffusion electrode or a gas diffusion layer, may include at least one binder which is not particularly restricted. It is also possible to use two or more different binders, including in different layers of the electrode. The binding agent or binder for the gas diffusion electrode, if present, is not particularly restricted and includes, for example, a hydrophilic and/or hydrophobic polymer, for example a hydrophobic polymer. This can achieve a suitable adjustment of the predominantly hydrophobic pores or channels. In particular embodiments, the at least one binder is an organic binder, for example selected from PTFE (polytetrafluoroethylene), PVDF (polyvinylidene difluoride), PFA (perfluoroalkoxy polymers), FEP (fluorinated ethylene-propylene copolymers), PFSA (perfluorosulfonic acid polymers), and mixtures thereof, especially PTFE. The hydrophobicity can also be adjusted using hydrophilic materials such as polysulfones, i.e. polyphenyl-sulfones, polyimides, polybenzoxazoles or polyetherketones, or generally polymers that are electrochemically stable in the electrolyte, for example including polymerized "ionic liquids", or organic conductors such as PEDOT:PSS or PANI (camphor-sulfonic acid-doped polyaniline). This can achieve a suitable adjustment of the hydrophobic pores or channels. More particularly, the gas diffusion electrode can be produced using PTFE particles having a particle diameter between 0.01 and 95 μm, preferably between 0.05 and 70 μm, further preferably between 0.1 and 40 μm, e.g. 0.3 to 20 μm, e.g. 0.5 to 20 μm, e.g. about 0.5 μm. Suitable PTFE powders include, for example, Dyneon® TF 9205 and Dyneon TF 1750. Suitable binder particles, for example PTFE particles, may, for example, be approximately spherical, for example spherical, and may be produced, for example, by emulsion polymerization. In particular embodiments, the binder particles are free of surface-active substances. The particle size can be determined here, for example, to ISO 13321 or D4894-98a and may correspond, for example, to manufacturer data (e.g. TF 9205: average particle size 8 μm to ISO 13321; TF 1750: average particle size 25 μm to ASTM D4894-98a).

The binder may be present, for example, in a proportion of 0.1% to 50% by weight, for example when a hydrophilic ion transport material is used, e.g. 0.1% to 30% by weight, preferably from 0.1% to 25% by weight, e.g. 0.1% to 20% by weight, further preferably from 3% to 20% by weight, further preferably 3% to 10% by weight, even further preferably 5% to 10% by weight, based on the electrode, especially based on the gas diffusion electrode, or on the catalytically active region, for example a layer, of the electrode. In particular embodiments, the binder has significant shear-thinning characteristics, such that fiber formation takes place during the mixing process. Ion transport materials may be mixed in, for example, with higher contents when they contain hydrophobic or hydrophobizing structural units especially containing F, or fluorinated alkyl or aryl units. Fibers formed in the course of production can wind around the particles without completely surrounding the surface. The optimal mixing time can be determined, for example, by direct visualization of the fiber formation in a scanning electron microscope.

It is also possible to employ an ion transport material in the electrode of embodiments, which is not particularly restricted. The ion transport material, for example an ion exchange material, may, for example, be an ion exchange resin, or else a different ion transport material, for example an ion exchange material, for example a zeolite, etc. In particular embodiments, the ion transport material is an ion exchange resin. This is not particularly restricted here. In particular embodiments, the ion transport material is an anion transport material, for example an anion exchange resin. In particular embodiments, the anion transport material or anion transporter is an anion exchange material, for example an anion exchange resin. In particular embodiments, the ion transport material also has a cation blocker function, i.e. can prevent or at least reduce penetration of cations into the electrode, especially a gas diffusion electrode or an electrode having a gas diffusion layer. Specifically an integrated anion transporter or an anion transport material with firmly bound cations can constitute a barrier here to mobile cations through coulombic repulsion, which can additionally counteract salt deposition, especially within a gas diffusion electrode or a gas diffusion layer. It is unimportant here whether the gas diffusion electrode is fully permeated by the anion transporter. Anion-conducting additives can additionally increase the performance of the electrode, especially in a reduction. It is possible here to use an ionomer, for example 20% by weight alcoholic suspension or a 5% by weight suspension of an anion exchanger monomer (e.g. AS 4 Tokuyama). It is also possible, for example, to use type 1 (typically trialkylammonium-functionalized resins) and type 2 (typically alkylhydroxyalkyl-functionalized resins) anion exchange resins.

A further embodiment relates to an electrolysis cell comprising the electrode of embodiments. The electrode may take the form here of a compact solid-state body, of a porous electrode, e.g. gas diffusion electrode, or of a coating body, for example with a gas diffusion layer. Preference is given here to executions as a gas diffusion electrode or electrode having a gas diffusion layer comprising or consisting of the tetragonally crystallized compound of the $I4_1/amd$ space group. In the electrolysis cell, the electrode of embodiments is preferably the cathode, in order to enable reduction, for example the reduction of a gas comprising or consisting of $CO_2$ and/or CO.

The further constituents of the electrolysis cell are not particularly restricted, and include those that are commonly used in electrolysis cells, for example a counterelectrode.

In the electrolysis cell, the electrode of embodiments may be a cathode, i.e. be connected as cathode. In particular embodiments, the electrolysis cell further comprises an anode and at least one membrane and/or at least one diaphragm between the cathode and anode, for example at least one anion exchange membrane.

The further constituents of the electrolysis cell, for instance the counterelectrode, e.g. the anode, optionally a membrane and/or a diaphragm, feed(s) and drain(s), the voltage source, etc., and further optional devices such as heating or cooling devices, are not particularly restricted. The same applies to anolytes and/or catholytes that are used in such an electrolysis cell, with use of the electrolysis cell in particular embodiments on the cathode side for reduction of carbon dioxide and/or CO. In the context of the invention, the configuration of the anode space and of the cathode space is likewise not particularly restricted.

An electrolysis cell of embodiments may likewise be employed in an electrolysis system. An electrolysis system is thus also specified, comprising the electrode or the electrolysis cell of embodiments.

A suitable electrolysis cell for the use of the electrode of embodiments of the invention, for example a gas diffusion electrode, comprises, for example, the electrode as cathode with an anode that is not subject to any further restriction. The electrochemical conversion at the anode/counterelectrode is likewise not particularly restricted. The cell is preferably divided by the electrode as gas diffusion electrode or as electrode having a gas diffusion layer into at least two chambers, of which the chamber remote from the counterelectrode (behind the GDE) functions as gas chamber. One or more electrolytes may flow through the remainder of the cell. The cell may also comprise one or more separators, such that the cell may also comprise, for example, 3 or 4 chambers. These separators may be either gas separators (diaphragms) having no intrinsic ion conductivity or ion-selective membranes (anion exchange membrane, cation exchange membrane, proton exchange membrane) or bipolar membranes, which are not particularly restricted. It is possible for one or more electrolytes to flow across these separators from both sides, or else, if they are suitable for this kind of operation, for the separators to directly adjoin one of the electrodes. For example, both the cathode and the anode may be executed as a half-membrane electrode composite, where, in the case of the cathode, the electrode of embodiments, especially as a gas diffusion electrode or as an electrode with a gas diffusion layer, is preferably part of this composite. The counterelectrode may also be executed, for example, as a catalyst-coated membrane. In a two-chamber cell, it is also possible for both electrodes to directly adjoin a common membrane. If the electrode of embodiments as a gas diffusion electrode does not directly adjoin a separator membrane, either "flow-through" operation in which the feed gas flows through the electrode or "flow-by" operation in which the feed gas is guided past the side remote from the electrolyte is possible. If the gas diffusion electrode directly adjoins the separator or one of the separators, accordingly, only "flow-by" operation is possible. Reference is made to "flow-by" particularly when more than 95% by volume, preferably more than 98% by volume, of the product gases is discharged via the gas side of the electrode.

Figure 23:
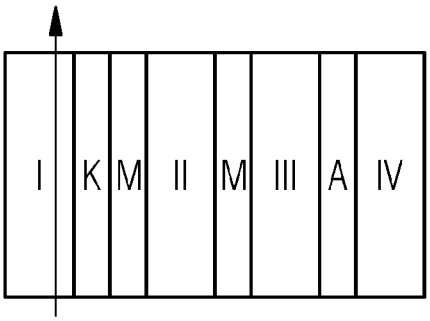
Figure 24:
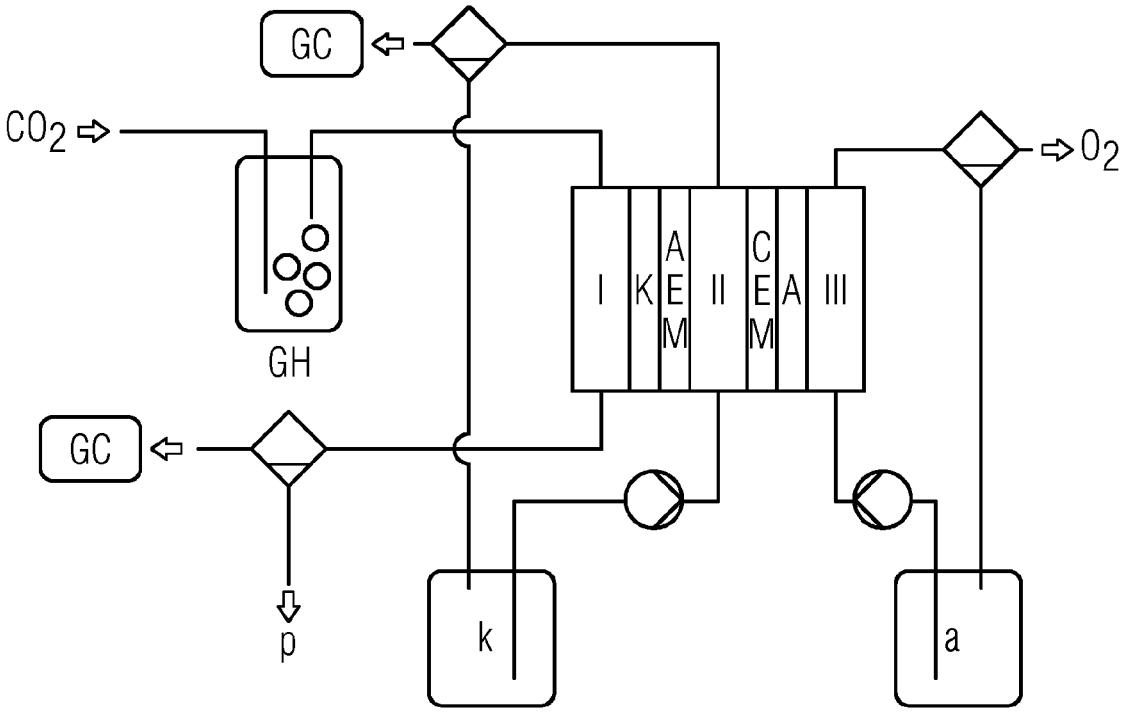
Figure 25:
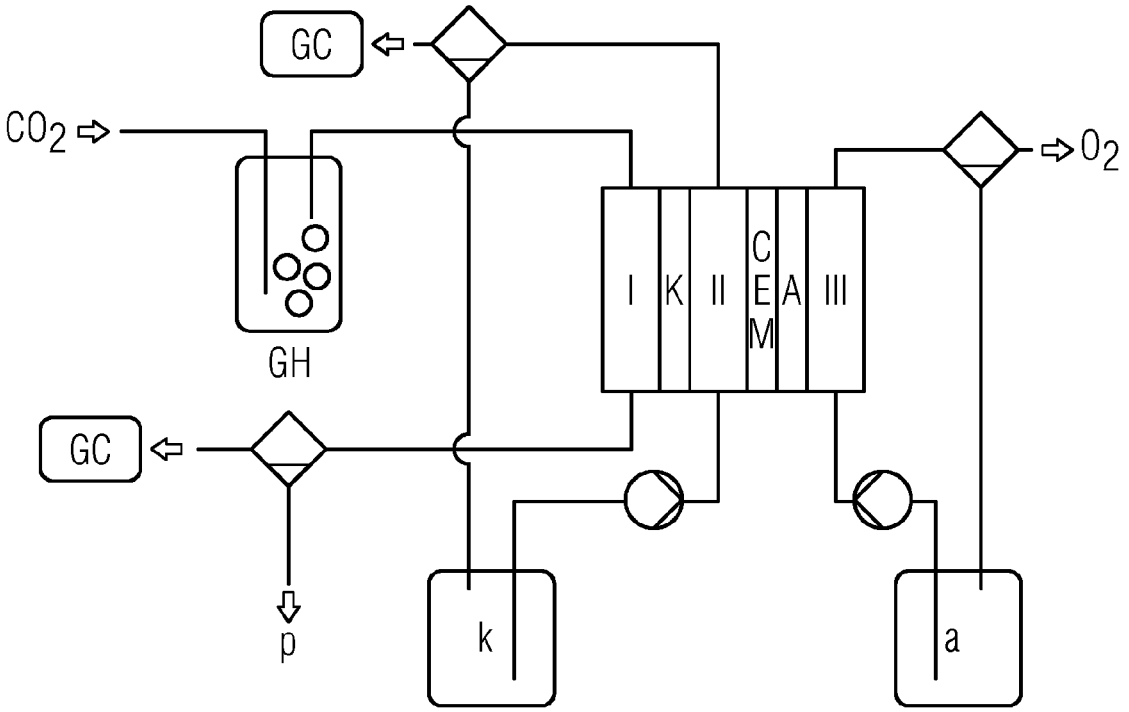
Figure 26:
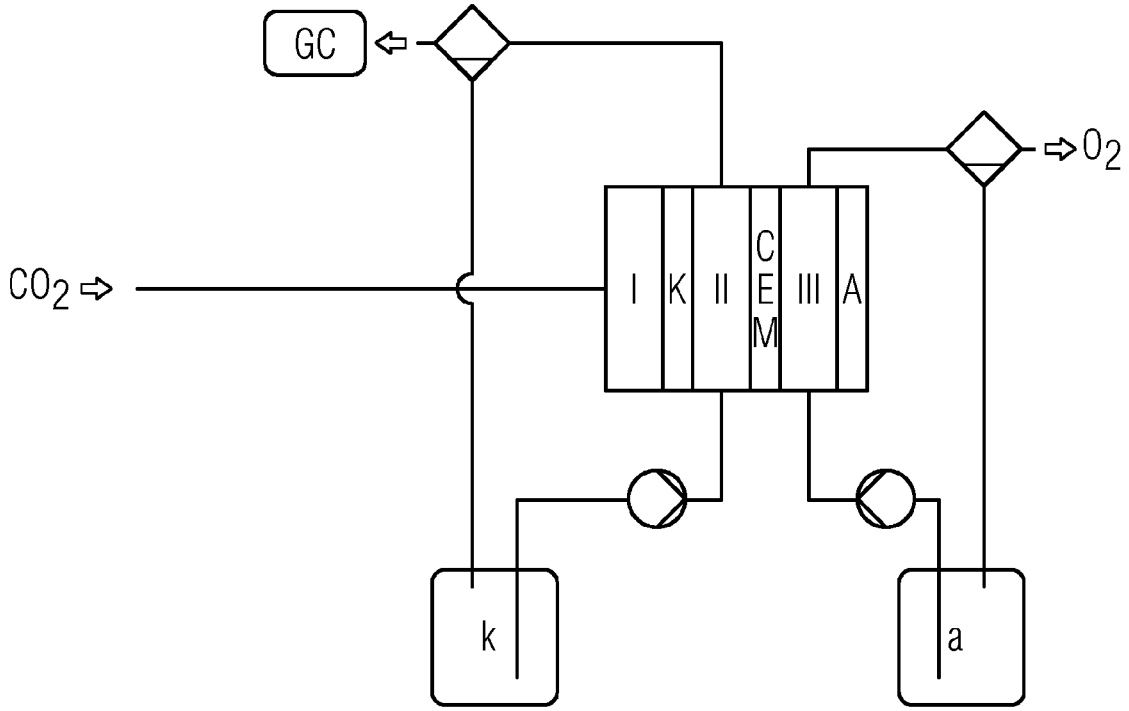

Illustrative configurations for a construction of electrolysis cells in embodiments of the invention—including in accordance with the above remarks—and for anode and cathode spaces are shown in schematic form in FIGS. 9 to 26, with further constituents of an electrolysis system shown in schematic form in FIGS. 24 to 26. There follows an elucidation of concepts of electrolysis cells that are compatible with the process of embodiments of the invention for electrochemical conversion of carbon dioxide and/or carbon monoxide and can be used in embodiments of the process.

The following abbreviations are used in FIGS. 9 to 26:

I-IV: spaces in the electrolysis cell, as respectively described hereinafter

K: cathode

M: membrane

A: anode

AEM: anion exchange membrane

CEM: cation/proton exchange membrane

DF: diaphragm k: catholyte a: anolyte

GC: gas chromatograph

GH: gas humidification

P: permeate

The other symbols in the diagrams are standard fluidic connection symbols.

FIGS. 9 to 26 show illustrative constructions of the different membranes, but these do not restrict the cells shown. For instance, rather than a membrane, it is also possible to provide a diaphragm. FIGS. 9 to 26 also show, on the cathode side, reduction of a gas, for example comprising or essentially consisting of $CO_2$, where the electrolysis cells are also not restricted thereto and, accordingly, reactions on the cathode side in the liquid phase or solution, etc., are also possible. In this regard too, the figures do not restrict the electrolysis cell of embodiments. It is likewise possible for anolytes, catholytes and any electrolytes in an interspace in the various constructions to be the same or different, and they are not particularly restricted.

Figure 9:
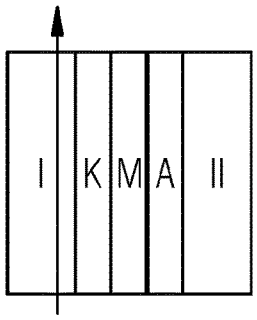
FIGS. 9 to 26 illustrative, schematic configurations for the construction of electrolysis cells according to embodiments.
Figure 10:
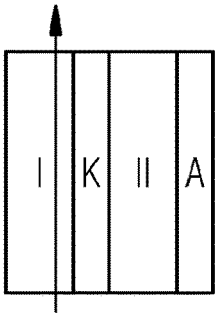
Figure 11:
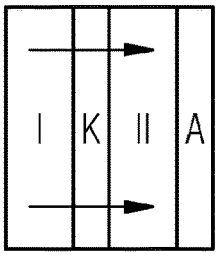

FIG. 9 shows an arrangement in which both the cathode K and the anode A adjoin a membrane M, and a reaction gas flows past the back of the cathode K in the cathode space I. On the anode side is the anode space II. In FIG. 10, by comparison with FIG. 9, there is no membrane, and cathode K and anode A are separated by the space IF The construction in FIG. 11, in terms of its construction, corresponds essentially to that of FIG. 10, except that the cathode K here is in flow-through mode.

Figure 12:
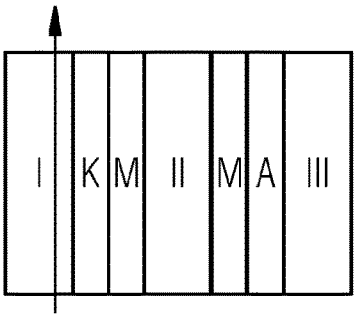
Figure 13:
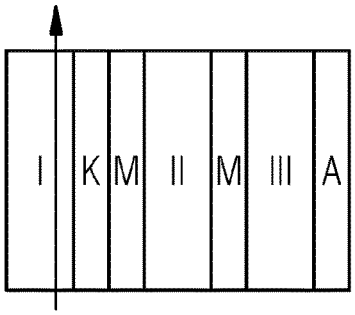

FIG. 12 shows a two-membrane arrangement, wherein a bridge space II is provided between two membranes, which electrolytically couples the cathode K and the anode A. The cathode space I corresponds to that of FIG. 9, and the anode space III to the anode space II of FIG. 9. The arrangement in FIG. 13 differs from that of FIG. 12 in that the anode A does not adjoin the second membrane M on the right.

Figure 14:
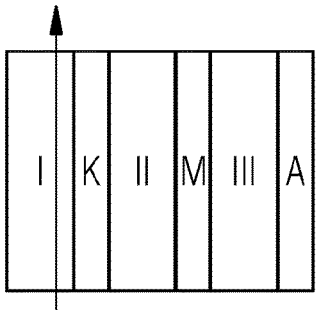
Figure 15:
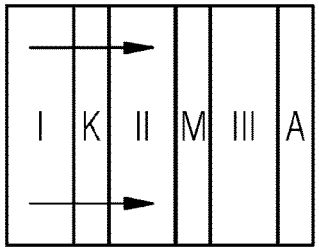
Figure 16:
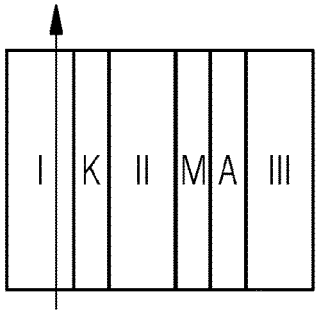
Figure 17:
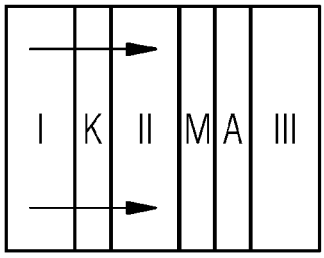
Figure 18:
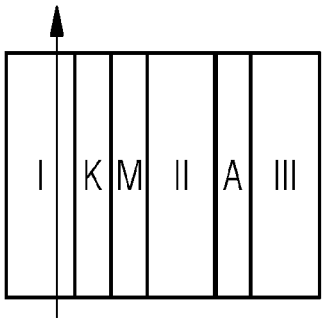

FIGS. 14 to 18 again show arrangements with just one membrane. In FIG. 14, as in FIG. 9, the cathode K in space I is in flow-by mode, while a cathode space II adjoins the membrane M on the other side. The membrane M is in turn separated from the anode A by the anode space III. The construction in FIG. 15 corresponds to that in FIG. 14, except that the cathode K here is in flow-through mode. In FIGS. 16 and 17, the membrane M directly adjoins the anode A, such that the anode space III is on the side of the anode A remote from the membrane M; otherwise, these respectively show the flow-by and flow-through variant of FIGS. 14 and 15. FIG. 18 shows a flow-by variant in which the membrane M adjoins the cathode, space II establishes electrolytic contact with the anode A, and space III is on the opposite side of the anode A.

Figure 19:
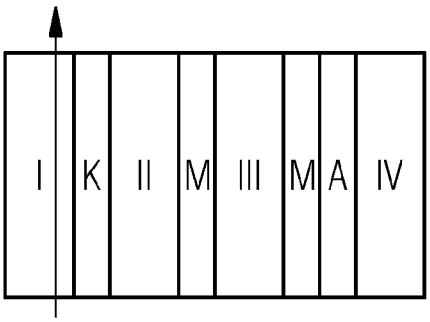
Figure 20:
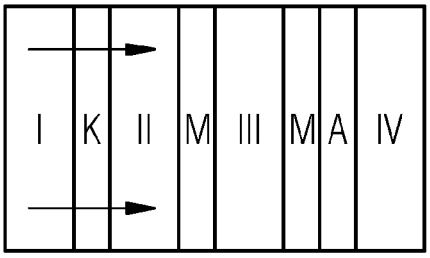
Figure 21:
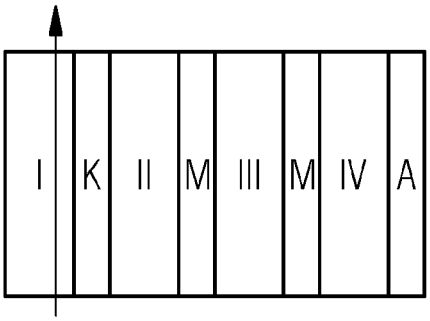
Figure 22:
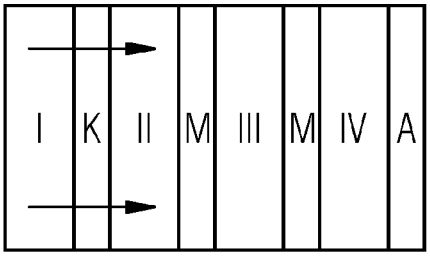

FIGS. 19 to 23 show further variants of two-membrane arrangements with flow-by variants of the cathode in FIGS. 19, 21 and 23, and flow-through variants in FIGS. 20 and 22. In FIGS. 19 and 20, a membrane (on the right) adjoins the anode, such that the anode space IV adjoins the anode on the right and coupling to the cathode space II takes place via the bridge space III. Such coupling likewise takes place in FIGS. 21 and 22, where the anode space IV here lies between membrane M and anode A. In FIG. 23, again, a membrane M (on the left) adjoins the cathode K, such that coupling to the anode space III via the bridge space II is envisaged, with a further space IV provided to the right of the anode A, in which, for example, a further reactant gas for oxidation at the anode A can be supplied.

FIGS. 24 to 26 show cell variants in which, by way of example, reduction of $CO_2$ at the cathode K after supply to space I and oxidation of water at the anode A—which is supplied to the anode space III with the anolyte a—to oxygen is shown, where these reactions do not restrict the electrolysis cells and electrolysis systems shown. FIGS. 24 and 25 additionally show that the $CO_2$ can be humidified in a gas humidification GH, in order to facilitate ionic contacting with the cathode K. In addition, as shown in FIGS. 24 to 26, the product gas from the reduction can additionally be analyzed with a gas chromatograph GC. The same applies, as shown in FIGS. 24 and 25, after removal of a permeate p for the reactant gas. In the example of FIG. 24, a catholyte k is supplied to the bridge space II, which enables electrolytic coupling between cathode K and anode A, with the cathode K adjoining an anion exchange membrane AEM and the anode A adjoining a cation exchange membrane CEM. In the example of FIG. 25, only a cation exchange membrane CEM is present; otherwise, the construction corresponds to that of FIG. 24, except that the space II here is in direct contact with the cathode K, i.e. does not constitute a bridge space. In the cell construction of FIG. 26, by comparison with FIG. 25, the cation exchange membrane CEM does not adjoin the anode.

In addition, there are also possible cell variants as already described in DE 10 2015 209 509 A1, DE 10 2015 212 504 A1, DE 10 2015 201 132 A1, DE 102017208610.6, DE 102017211930.6, US 2017037522 A1 or U.S. Pat. No. 9,481,939 B2, and in which an electrode of embodiments of the invention may likewise be employed.

As apparent from the above, the present electrode results in a multitude of possible cell arrangements.

The description that follows relates to processes according to embodiments of the invention for production of electrodes. The processes can especially produce an electrode of embodiments, such that elucidations relating to particular constituents of the electrode can also be applied to the processes.

The present invention also relates to a process for producing an electrode, especially an electrode according to one of the embodiments of the invention, comprising—providing at least one tetragonally crystallized compound containing at least one element selected from Cu and Ag, wherein the crystal lattice of the compound belongs to the $I4_1/amd$ space group; and further comprising a step selected from: —applying the compound to a support; and—forming the compound to an electrode.

In embodiments of the process, the tetragonally crystallized compound may also be selected from $Cu_4O_3$ and a compound isomorphous with $Cu_4O_3$, especially a compound isomorphous with paramelaconite. It is possible here, in the crystal lattice of the compound isomorphous with $Cu_4O_3$ ($Cu^+{}_2Cu^{2+}{}_2O_3$), for at least one of lattice sites corresponding to the $Cu^+$ and the $Cu^{2+}$ to contain Cu or Ag or proportions of Cu or Ag. It is possible here for the compound isomorphous with $Cu_4O_3$ to be selected from $Ag_{0.58}CeSi_{1.42}$, $Ag_2Cu_2O_3$, $Ag_{0.28}Si_{1.72}Yb$, $Cu_{1.035}TeI$, $CuCr_2O_4$, $C_4H_4CuN_6$, $Ag_{0.7}CeSi_{1.3}$, $Ag_8O_4S_2Si$, $Ag_3CuS_2$, CuTeCl, $Ba_2Cs_2Cu_3F_{12}$, $CuO_4Rh_2$, $CuFe_2O_4$, $Ag_{0.3}CeSi_{1.7}$, $Ag_6O_8SSi$, $BaCuInF_7$, $Cu_{0.99}TeBr$, $BaCu_2O_2$, $Cu_{16}O_{14.15}$, $YBa_2Cu_3O_6$ and $C_8Ag_9Cl_6Cs_5N_8$. In particular, it is possible to use any combination of the tetragonally crystallized compounds mentioned. The elucidations given above relating to the crystal lattice of the compound isomorphous with $Cu_4O_3$ ($Cu^+{}_2Cu^{2+}{}_2O_3$) are correspondingly applicable.

The step of providing the compound may comprise a preparation of the tetragonally crystallized compound containing at least one element selected from Cu and Ag, wherein the crystal lattice of the compound belongs to the $I4_1/amd$ space group. This is especially true when the compound is provided in a mixture. The preparation of a mixture comprising the compound and optionally, for example, at least one binder is not particularly restricted here and can be effected in a suitable manner. For example, the mixing can be effected with a knife mill, but is not limited thereto. In a knife mill, a preferred mixing time is in the range of 60-200 s, preferably between 90-150 s. Other mixing times may also correspondingly result for other mixers. In particular embodiments, however, the producing of the mixture comprises mixing for 60-200 s, preferably 90-150 s.

In further embodiments of the process, the step of applying the compound to the support may be selected from—applying a mixture or powder comprising the compound to the support and dry rolling the mixture or powder onto the support; —applying a dispersion comprising the compound to the support; and—contacting the support with a gas phase comprising the compound, and applying the compound to the support from the gas phase.

The thickness of the layer of the compound applied to the support may be in the region of 10 nm or more, preferably 50 nm to 0.5 mm. The compound may be applied to the support in each case with a mass coverage of at least 0.5 $mg/cm^2$.

For processing of a mixture, for example a powder mixture, or of a powder, to give an electrode, especially a gas diffusion electrode or an electrode with a gas diffusion layer, a dry calendering operation may be used, for example the dry calendering method described in DE 102015215309.6 or WO 2017/025285. In this respect, reference may also be made to these applications with regard to the step of applying in which a dry calendering operation can be executed. The same applies to embodiments of the process in which the compound is formed to an electrode, which may likewise include a dry calendering operation.

The applying of the mixture or the powder to a support, for example a copper-containing support, preferably in the form of a sheetlike structure, is likewise not particularly restricted, and can be effected, for example, by applying in powder form. The support here is not particularly restricted and may correspond to the above descriptions in relation to the electrode, and it may be executed here, for example, as a mesh, grid, etc.

The dry rolling of the mixture or powder onto the support is not particularly restricted either, and can be effected, for example, with a roller. In particular embodiments, the rolling is effected at a temperature of 25-100° C., preferably 60-80° C.

It is also possible to apply multiple layers jointly to a support and roll them on by this method, for example a hydrophobic layer that can establish better contact with a gas comprising $CO_2$ and hence can improve gas transport to the catalyst.

In addition, the tetragonally crystallized compound containing at least one element selected from Cu and Ag, wherein the crystal lattice of the compound belongs to the $I4_1/amd$ space group, may be sieved onto an existing electrode without an additional binder. In that case, the base layer may be produced, for example, from powder mixtures of a Cu powder, for example with a grain size of 100-160 μm, with a binder, e.g. 10-15% by weight of PTFE Dyneon TF 1750 or 7-10% by weight of Dyneon TF 2021.

The step of applying the compound may additionally be executed by applying a dispersion comprising the compound, as specified above. The dispersion may be a suspension. Such an application of the compound can be effected as follows: —applying a suspension comprising the compound and optionally at least one binder to the support, and—drying the suspension; or—applying the compound or a mixture comprising the compound to the support from the gas phase.

In this way, it is especially possible to produce gas diffusion layers. For this purpose, for example, a suspension wet deposition or a vapor deposition method may be used. In addition, it is possible to produce thin layers of paramelaconite, for example, based on laser ablation, electron microscope, DC reactive sputtering or chemical vapor deposition (CVD).

In the processes of embodiments in which the compound is applied to a support, a support may be provided. The providing of the support is not particularly restricted, and it is possible to use, for example, the support discussed in the context of the electrode, for example including a support of a gas diffusion electrode, a gas diffusion electrode or a gas diffusion layer, for example on a suitable substrate. In addition, in embodiments of the process, the applying of the suspension is not particularly restricted, and can be effected, for example, by dropwise application, dipping, etc. The material may thus, for example, be applied as a suspension to a commercially available GDL (e.g. Freudenberg C2, Sigracet 35 BC). It is preferable when an ionomer, for example 20% by weight alcoholic suspension or a 5% by weight suspension of an anion exchange ionomer (e.g. AS 4 Tokuyama) is also used here, and/or other additives, binders, etc., which have been discussed in the context of the electrode of embodiments of the invention. For example, it is also possible to use type 1 (typically trialkylammonium-functionalized resins) and type 2 (typically alkylhydroxyalkyl-functionalized resins) anion exchange resins.

The drying of the suspension is likewise not restricted and it is possible, for example, to effect solidification by evaporating or precipitating with removal of the solvent or solvent mixture of the suspension, which are not particularly restricted.

In the alternative embodiment of applying the compound or a mixture comprising the compound from the gas phase, the providing of a support is likewise not particularly restricted, and can be effected as above. The applying of the compound or of the mixture comprising the compound from the gas phase is likewise not particularly restricted and can be effected, for example, based on physical vapor deposition methods such as laser ablation or chemical vapor deposition (CVD). It is possible in this way to obtain thin films comprising, for example, paramelaconite or isomorphs thereof and mixtures thereof.

In particular embodiments, the support is a gas diffusion electrode, a support of a gas diffusion electrode or a gas diffusion layer.

As elucidated above, in an alternative embodiment of the process, after the providing of the at least one tetragonally crystallized compound containing at least one element selected from Cu and Ag, wherein the crystal lattice of the compound belongs to the $I4_1/amd$ space group, forming of the compound to an electrode is conducted. For example, the process may comprise preparation of a powder comprising the compound and rolling of the powder to give an electrode. The preparation of the powder is not particularly restricted here, nor is the rolling to give a powder, for example with a roller. The rolling can be effected, for example, at a temperature of 15 to 300° C., e.g. 20 to 250° C., e.g. 22 to 200° C., preferably 25-150° C., further preferably 60-80° C. With regard to the powder, it is also possible to refer again to the embodiments above relating to the electrode of embodiments. In addition, it is possible to form a mixture comprising the compound to give the electrode, where the mixture may be pulverulent or may contain a liquid.

In the above-specified processes in which, as well as the compound tetragonally crystallized in the $I4_1/amd$ space group, containing at least one element selected from Cu and Ag, it is also possible for other constituents to be present in a mixture or suspension, the at least one binder in particular embodiments is present in the mixture or the suspension, where the at least one binder preferably comprises an ionomer. In particular embodiments, the at least one binder is present in the mixture or the suspension in an amount of >0% to 30% by weight, based on the total weight of the compound and the at least one binder.

By the process of embodiments of the invention, it is possible to produce the electrode in such a way that the compound is present in an amount of 0.1-100% by weight, preferably 40-100% by weight, further preferably 70-100% by weight, based on the electrode, especially based on the gas diffusion electrode, or on the catalytically active region, for example a layer of the electrode.

A further embodiment of the present invention is directed to a process for electrochemical conversion of $CO_2$ and/or CO (carbon dioxide and/or carbon monoxide), wherein $CO_2$ and/or CO are introduced at the cathode into an electrolysis cell comprising an electrode of embodiments as cathode and reduced.

The present invention thus also relates to a process and to an electrolysis system for electrochemical carbon dioxide utilization. Carbon dioxide ($CO_2$) is introduced into an electrolysis cell and reduced on the cathode side at a cathode with the aid of an electrode of embodiments, for example a gas diffusion electrode (GDE). GDEs are electrodes in which liquid, solid and gaseous phases are present and in which the conductive catalyst catalyzes the electrochemical reaction between the liquid and gaseous phases.

The introducing of the carbon dioxide and/or optionally also carbon monoxide at the cathode is not particularly restricted here, and can be effected, for example, from the gas phase or from a solution.

In order to assure a sufficiently high conductivity in the cathode space, an aqueous electrolyte in contact with the electrode used as cathode, in particular embodiments, contains what is called a dissolved "conductive salt", which is not particularly restricted. The electrocatalyst used in embodiments brings about a high Faraday efficiency at high current density for a corresponding target product and additionally has prolonged stability. For the selective production of the carbon monoxide product, pure silver catalysts that meet industrial demands are already available. For the selective electrode reduction of $CO_2$ to ethylene or alcohols, however, there are currently no known catalysts that meet these demands. The synthesis concept described here using an electrode of embodiments of the invention enables the production of electrocatalysts having a low overvoltage and an elevated selectivity for hydrocarbons, especially for ethylene, and alcohols, for example ethanol and/or propanol.

In particular embodiments, the electrochemical conversion, for example an electrolysis, is effected at a current density of 100 mA/cm$^2$ or more, preferably 200 mA/cm$^2$ or more, further preferably 300 mA/cm$^2$ or more, even further preferably 350 mA/cm$^2$ or more, especially at more than 400 mA/cm$^2$. Preferably, the electrochemical conversion at the cathode is effected at a pH of pH=6-14, preferably at a pH between 10 and 14.

In the reduction at the cathode, it is especially also possible to obtain ethylene. Thus, the process according to embodiments for electrochemical conversion of $CO_2$ and/or CO is also a process for preparing ethylene.

Furthermore, the invention also relates to use of a tetragonally crystallized compound containing at least one element selected from Cu and Ag, wherein the crystal lattice of the compound belongs to the $I4_1/amd$ space group, for reduction of $CO_2$, or in the electrolysis of $CO_2$. In addition, in a further embodiment of the invention, a use of an electrode of embodiments for reduction or in the electrolysis of $CO_2$ and/or CO is specified. In the uses of embodiments, the tetragonally crystallized compound may be selected from $Cu_4O_3$ and a compound isomorphous with $Cu_4O_3$. It is possible here, in the crystal lattice of the compound isomorphous with $Cu_4O_3$ ($Cu^+{}_2Cu^{2+}{}_2O_3$), for at least one of lattice sites corresponding to the $Cu^+$ and the $Cu^{2+}$ to contain Cu or Ag or proportions of Cu or Ag. It is possible here for the compound isomorphous with $Cu_4O_3$ to be selected from $Ag_{0.58}CeSi_{1.42}$, $Ag_2Cu_2O_3$, $Ag_{0.28}Si_{1.72}Yb$, $Cu_{1.035}TeI$, $CuCr_2O_4$, $C_4H_4CuN_6$, $Ag_{0.7}CeSi_{1.3}$, $Ag_8O_4S_2Si$, $Ag_3CuS_2$, CuTeCl, $Ba_2Cs_2Cu_3F_{12}$, $CuO_4Rh_2$, $CuFe_2O_4$, $Ag_{0.3}CeSi_{1.7}$, $Ag_6O_8SSi$, $BaCuInF_7$, $Cu_{0.99}TeBr$, $BaCu_2O_2$, $Cu_{16}O_{14.15}$, $YBa_2Cu_3O_6$ and $C_8Ag_9Cl_6Cs_5N_8$. In particular, it is possible to use any combination of the tetragonally crystallized compounds mentioned. The elucidations given above relating to the crystal lattice of the compound isomorphous with $Cu_4O_3$ ($Cu^+2Cu^{2+}{}_2O_3$) are correspondingly applicable.

The above embodiments, configurations and developments can, if viable, be combined with one another as desired. Further possible configurations, developments and implementations of the invention also include combinations that have not been mentioned explicitly of features of the invention that have been described above or are described hereinafter with regard to the working examples. More particularly, the person skilled in the art will also add individual aspects to the respective basic form of the present invention as improvements or supplementations.

The invention is elucidated further in detail hereinafter with reference to various examples thereof. However, the invention is not limited to these examples.

EXAMPLES

Example 1 ($Cu_4O_3$)

The synthesis of $Cu_4O_3$ was inspired by a synthesis route (mg range) described in the publication by Zhao et al. (Zhao et al., Chem. Mater. 2012, 24, pages 1136-1142).

The synthesis comprised a dissolution of 50 mM $Cu(NO_3)_2.3H_2O$ in 1.1 L of mixed ethanol-DMF solvent (the volume ratio of ethanol to DMF is 1:2). The solution was stirred for 10 min and then transferred to a 1.5 L glass insert that was then inserted into a stainless steel autoclave (BR-1500 high-pressure reactor, Berghof). The autoclave was closed and the reaction mixture was held therein at 130° C. for 24 h. After 24 h, the glass insert with the reaction mixture was removed from the autoclave and cooled down to room temperature by means of an ice bath. The reaction product precipitated out in the glass insert. After cooling, the supernatant was removed from the glass insert and the remaining solid-state product was collected by centrifuging and washing three times with ethanol. The powder obtained was first dried under an argon stream and then dried under reduced pressure. Finally, the powder was stored in a glovebox under inert atmosphere.

Figure 27:
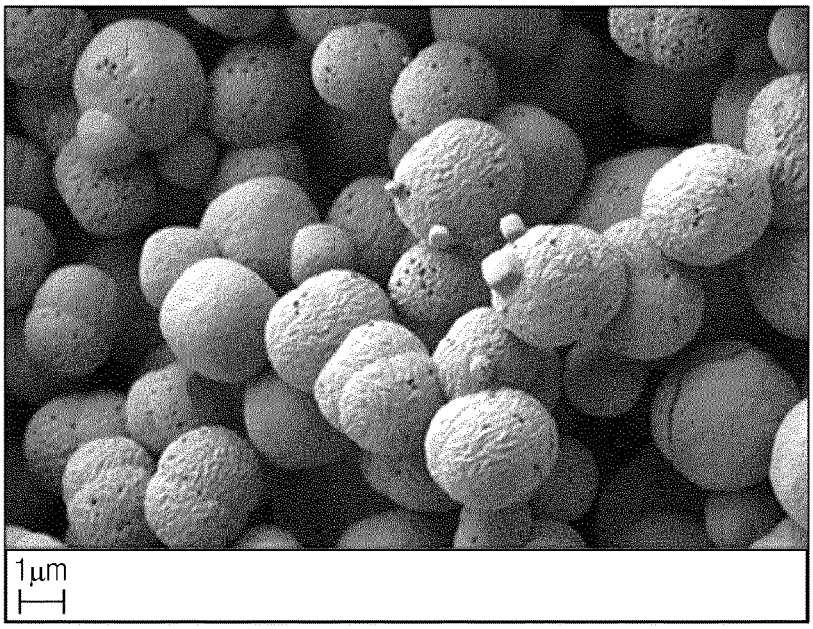
FIG. 27 an SEM image of example 1.

An x-ray diffractometry (XRD) analysis of the powder prepared showed the presence of the following phases, as shown in FIG. 2: $Cu_4O_3$ (reference numeral 13), $Cu_2O$ (reference numeral 11) and Cu (reference numeral 12). FIG. 2 is a plot of the angle 29 (coupled 2 theta/theta, WL=1.54060 angstrom) against the number of pulses I. A quantitative phase analysis was conducted. About 40% by weight of the powder obtained was $Cu_4O_3$; the remainder was $Cu_2O$ with traces of copper. An SEM image of the powder obtained is shown in FIG. 27.

A gas diffusion electrode (GDE) containing $Cu_4O_3$ as catalyst for $CO_2$ electroreduction was prepared as follows. The previously synthesized powder that contained $Cu_4O_3$ was cast onto a gas diffusion layer (GPL; Freudenberg H23C2 GDL) from solution, as follows. The binder used was an ionomer, AS4 from Tokuyama. The ionomer solution is added to the powder containing $Cu_4O_3$ catalyst particles that has been dispersed in 1-propanol beforehand. The amount of the catalyst powder used depends on the desired catalyst loading, but is generally set for a mass coverage on the gas diffusion layer of between 1 mg/cm$^2$ and 10 mg/cm$^2$, e.g. here by way of example 3.3 mg/cm$^2$, which was ascertained by weighing before and after the applying of the suspension. The dispersion was then left in an ultrasound bath for 30 min, whereupon a homogeneous catalyst ink was formed. After the ultrasound treatment, the catalyst ink was poured on and dried in an inert atmosphere (argon).

Electrochemical Tests of $Cu_4O_3$ as Catalyst

The electrochemical performance of the GDE containing $Cu_4O_3$ as catalyst was tested in the electrolysis setup described hereinafter. For this purpose, a stacked three-chamber flow cell was used. The first chamber, which was used as gas supply chamber, was separated from the second chamber by the GDE. The second and third chambers respectively contained a catholyte and an anolyte and were separated by a Nafion 117 membrane. The electrolytes were pumped through the cell in two separate cycles. The anode space was filled with 2.5 M KOH and had an $IrO_2$-containing anode. For the cathode space, the GDE was used as cathode and 0.5 M $K_2SO_4$ as electrolyte, with a pH range varying around pH 7. The counterelectrode used was a solid, $IrO_2$-coated Ti plate. The cell was equipped with an Ag/AgCl/3M KCl reference electrode. For potentiostatic measurements, the cathode was connected as working electrode.

In order to demonstrate activity and selectivity for ethylene, the GDE comprising $Cu_4O_3$ that was produced above was tested. In potentiostatic electrolysis mode, the cell potential was kept constant during the experiment. Other experiments were conducted in chronoamperometric mode, meaning that the current was kept constant while the potential of the cell and the potential of the electrode were monitored over time. These experiments were executed at different current densities (calculated by dividing the total current supplied by the GDE area that separates the first chamber from the second chamber (also called active geometric surface area of the GDE here)).

Analysis of Gaseous and Liquid Products

The gaseous products were taken every 15 min using gas sampling bags and analyzed with a Thermo Scientific Trace 1310 gas chromatograph (GC) equipped with two thermal conductivity detector (TCD) channels. In the case of a chronoamperometric extended electrolysis, the product gas from the flow reactor was guided directly to the GC. The hydrocarbons were separated with a GC column packed with micropacking (Shincarbon™, Restek, Bellefonte, PA, USA) with He as carrier gas. Hydrogen was measured on a packed 5 Å molecular sieve column (Restek, Bellefonte, PY, USA) with Ar as carrier gas.

The liquid products were analyzed as follows: once the electrochemical measurements were complete, 1 mL of the catholyte was taken and analyzed by nuclear magnetic resonance in order to detect liquid products. $^1$NMR spectra were recorded on a 400 MHz Bruker Avance 400 spectrometer equipped with a 5 mm Ag$^{31}$P Autotune BBO probe, a pulsed field gradient unit and a gradient control unit. NMR samples were produced as follows: 250 μL of $D_2O$ and 50 μL of an internal standard stock solution with 0.06 M potassium fumarate in water were added to 300 μL of electrolyte.

The Faraday efficiencies (FE) of the liquid and gaseous products were obtained by the following equation:

$$FE = \frac{eFn}{Q} = \frac{eFn}{It}$$

with F as the Faraday constant, I as the current, Q as the charge, e as the number of electrons transferred, t as the electrolysis time, and n as the amount of product in mol.

$CO_2$ Reduction Experiments Using $Cu_4O_3$ as Catalyst

Figure 28A:
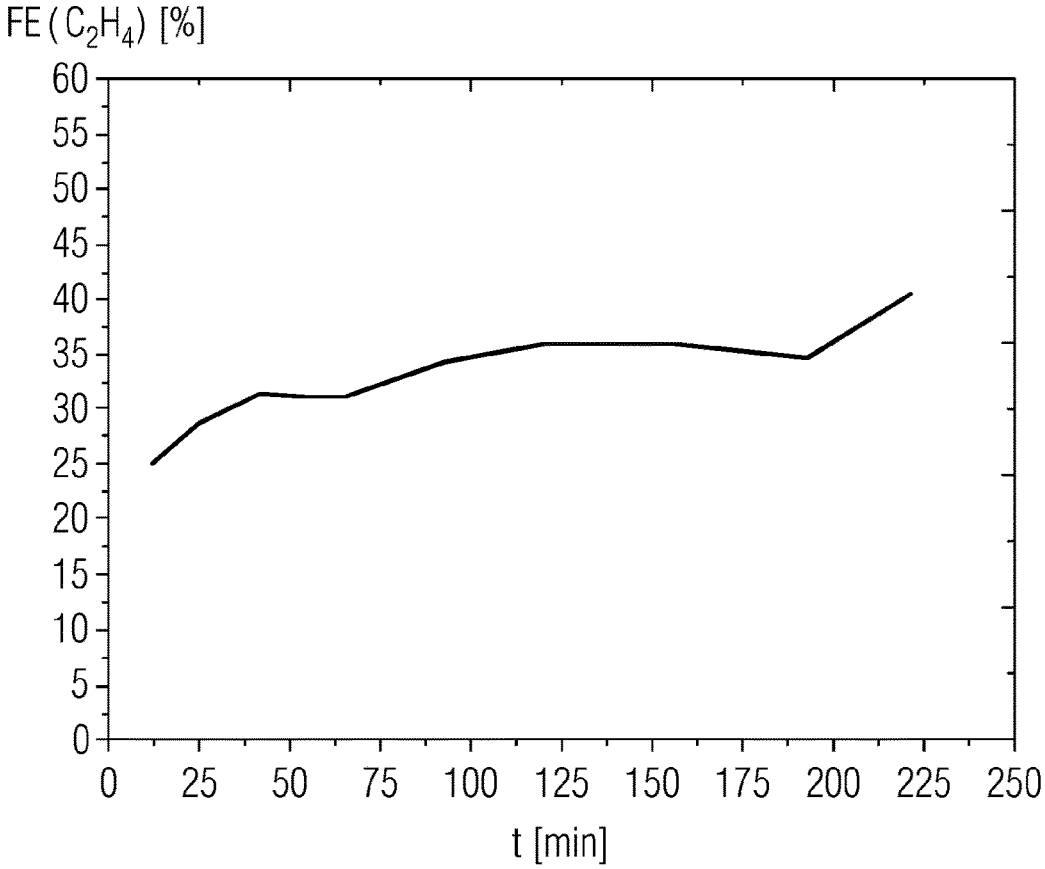
FIGS. 28*a* to 28*h* results of electrochemical measurements with $Cu_4O_3$ from example 1.

The result of the electrochemical measurement is shown in FIG. 28*a* as the Faraday efficiency as a function of time (t). As is apparent therefrom, the $Cu_4O_3$-containing GDE showed an excellent maximum selectivity of 40.5% Faraday efficiency (FE) for ethylene at 1.05 V (versus Ag/AgCl) and a current density J of 100 mA/cm$^2$.

Further gaseous products detected were: CO, $CH_4$, $C_2H_6$ and $H_2$.

Chronoamperometric $CO_2$ Reduction Experiments Using $Cu_4O_3$ as Catalyst

Figure 28B:
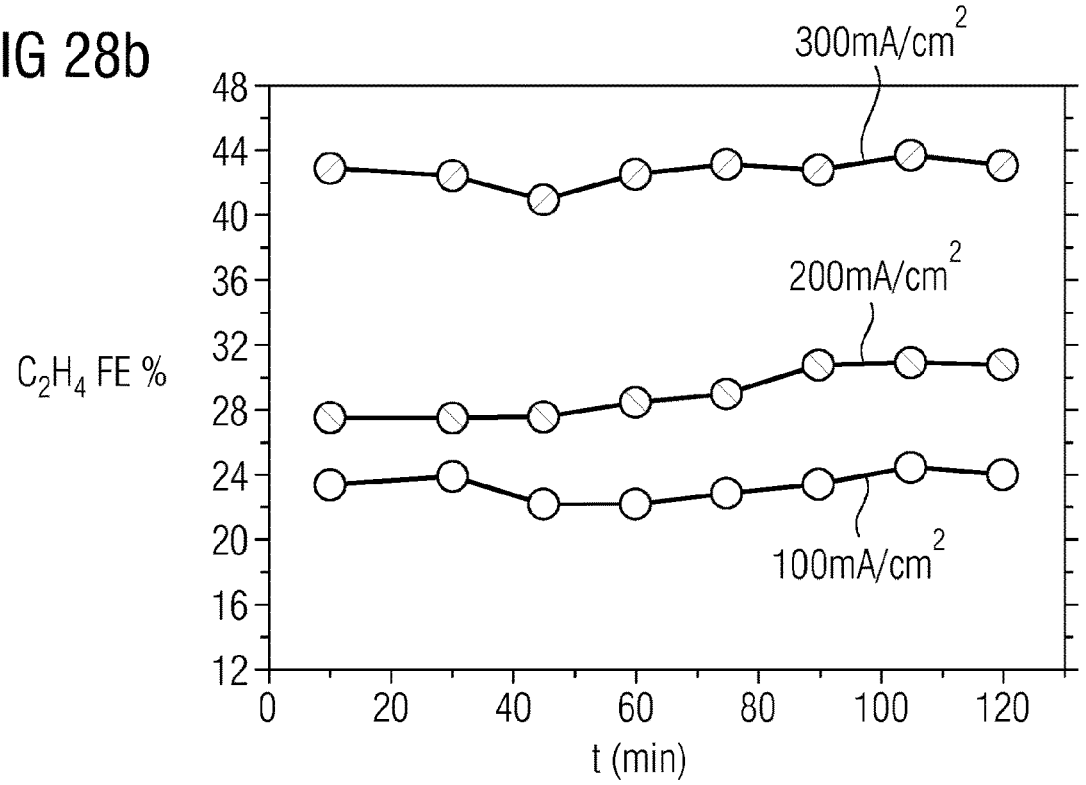
Figure 28C:
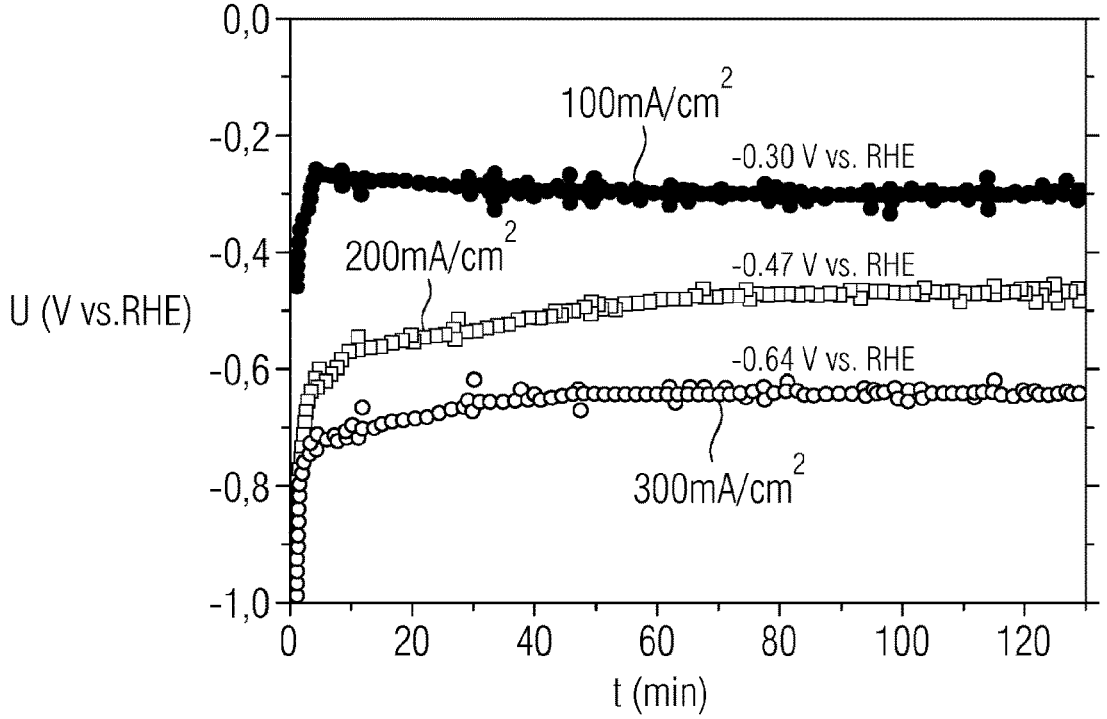
Figure 28D:
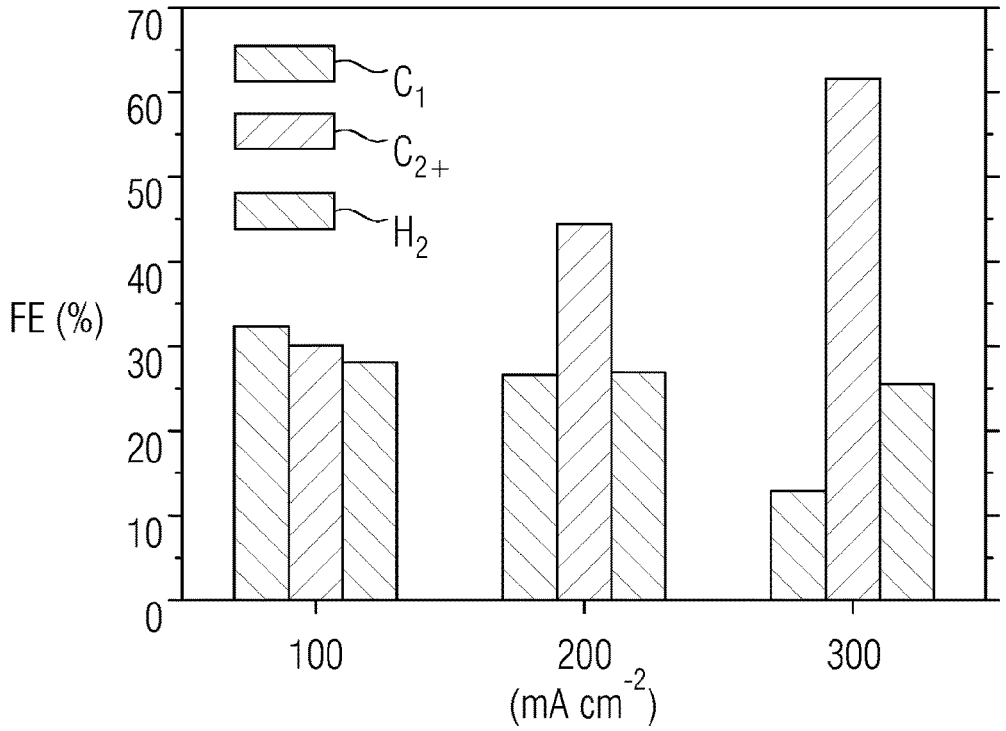
Figure 28E:
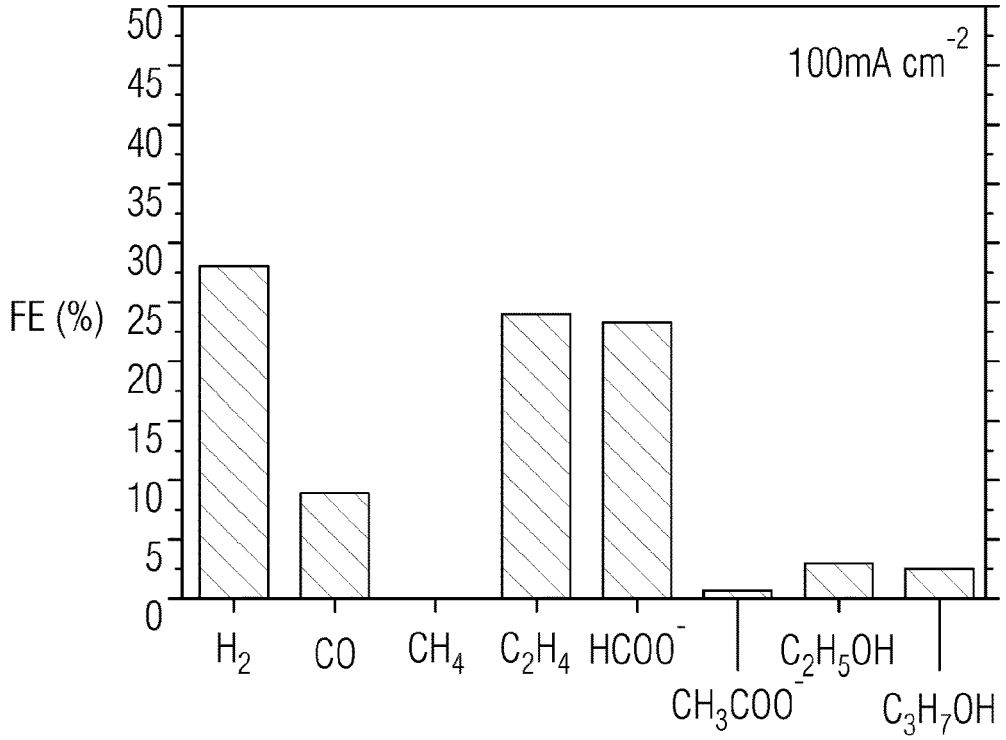
Figure 28F:
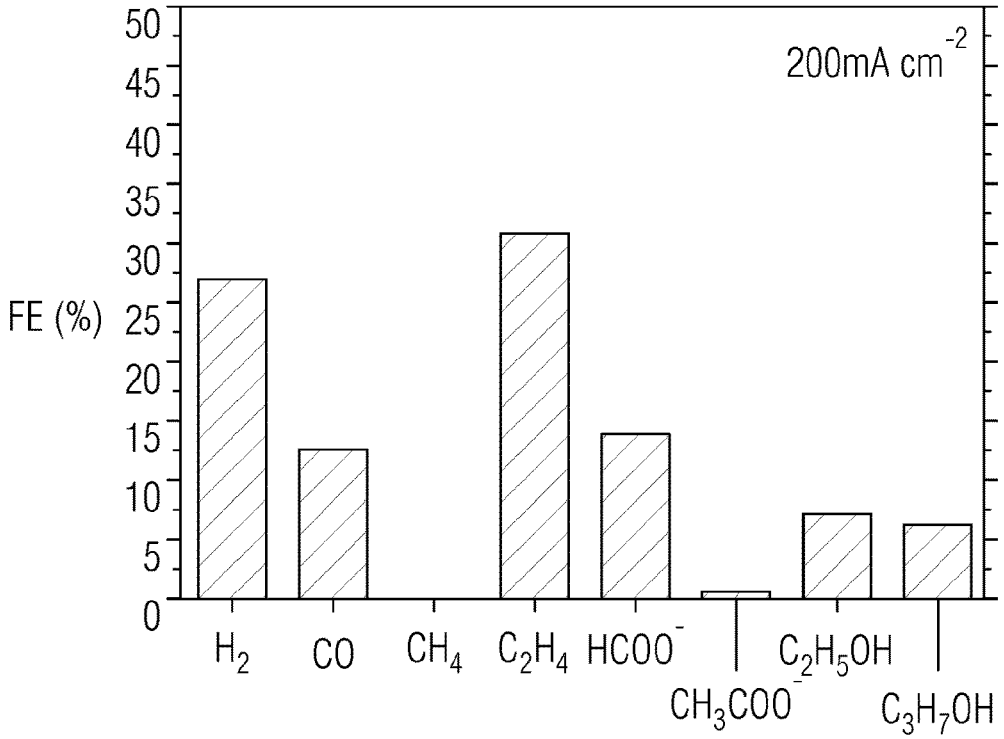
Figure 28G:
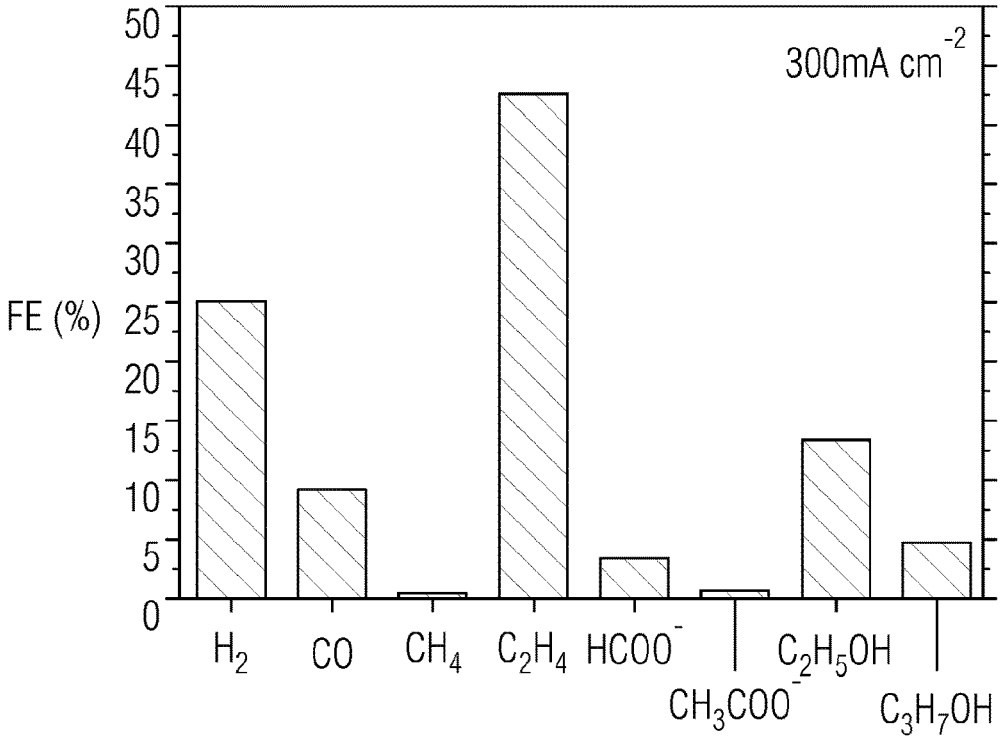
Figure 28H:
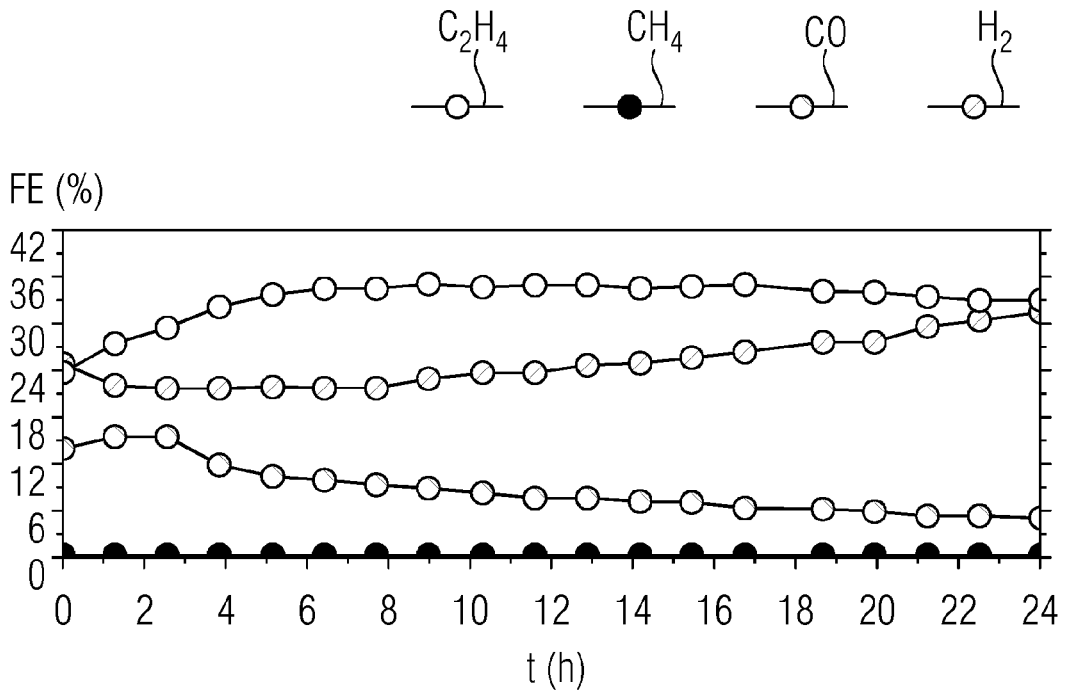

The results of the chronoamperometric experiments with $Cu_4O_3$ as catalyst are shown in FIGS. 28*b* to 28*h*, with detection of liquid products as well as gaseous products. FIGS. 28*b* to 28*g* show the combined results of three different experiments, i.e. conducted at three different current densities. FIG. 28*h* shows a prolonged stability experiment over 24 hours.

In detail, FIG. 28*b* shows a time-dependent progression of the Faraday efficiencies during an electrolysis at different current densities. FIG. 28*c* shows the time-dependent progression of the cathode potentials at different current densities. FIG. 28*d* illustrates Faraday efficiencies for all $C_1$ products (products having only one carbon atom) and $C_{2+}$ products (products having two or more carbon atoms) and $H_2$ at different current densities, calculated for a time point after two hours of electrolysis. FIGS. 28*e* to 28*g* show the individual Faraday efficiencies of all products detected that were obtained with $Cu_4O_3$ as catalyst under chronoamperometric conditions at 100 mA/cm$^2$ (FIG. 28*e*), 200 mA/cm$^2$ (FIG. 28*f*) and 300 mA/cm$^2$ (FIG. 28*g*) after two hours of electrolysis. FIG. 28*h* shows a time-dependent progression of the Faraday efficiencies of all gas products detected during a 24 h electrolysis at a constant current density of 200 mA/cm$^2$.

The current densities of these experiments were 100 to 300 mA/cm$^2$. The Faraday efficiency (FE) of ethylene using the $Cu_4O_3$ catalyst varied as a function of the current density applied since the increase in the current density moved the cathode potentials to more negative values. An increase in the current density by 100 mA/cm$^2$ correlated with a shift in the cathode potential by around 165 mV (FIGS. 28*b* and 28*c*). The results obtained show that the $Cu_4O_3$ selectivity for ethylene formation, after a startup phase, remained stable even after two hours at all the current densities studied. With rising current densities, there was surprisingly also a rise in the FE values for ethylene (FIG. 28*b*). The highest value (FE for ethylene of 43% at −0.64 V versus reversible hydrogen electrode RHE) was achieved here at the highest current density studied (300 mA/cm$^2$). For the other current densities studied, namely 100 mA/cm$^2$ and 200 mA/cm$^2$, Faraday efficiencies FE of 24% and 31% respectively were achieved for ethylene.

If all detectable products of the $CO_2$ reduction reaction from the experiments shown in FIGS. 28*b* to 28*e* are taken into account, it is apparent that the product distribution changes significantly with the current density applied (FIGS. 28*d* to 28*g*). The main products of the reduction reaction after two hours in the experiment at −0.31 V vs. RHE (100 mA/cm$^2$) were $C_1$ products (products having only one carbon atom; $FE_{c1}$ 32.3%), predominantly formate (FE 23.4%). The increase in the current density led to a decrease in the selectivity for $C_1$ products, with achievement of an $FE_{c1}$ of 26.4% at −0.47 V vs. RHE (200 mA/cm$^2$) and only an $FE_{c1}$ of 12.9% at −0.64 V vs. RHE (300 mA/cm$^2$). Methane formation was suppressed or reduced (FE 0.2%) and observed only at −0.64 V vs. RHE. $C_{2+}$ production (i.e. products having two or more carbon atoms) rose in turn when the current density was increased. The $C_{2+}$ products detected were ethylene, acetate, ethanol and n-propanol (FIGS. 28*e* to 28*g*). In all experiments, the main $C_{2+}$ product was ethylene. The lowest selectivity detected for $C_{2+}$ products was an $FE_{c2+}$ of 30% at −0.31 V vs. RHE (100 mA/cm$^2$), followed by $FE_{c2+}$ of 44.6% at −0.47 V vs. RHE (200 mA/cm$^2$). At −0.64 V vs. RHE, the Faraday efficiencies for $C_{2+}$ products reached their peak value of $FE_{c2+}$ 61.7%, with a corresponding partial current density of $j_{c2+}$=−185 mA/cm$^2$, and a high $C_{2+}/C_1$ product ratio of 4.8. As well as ethylene, a noticeable Faraday efficiency for ethanol (FE 13.4%) was measured at −0.64 V vs. RHE. The FE value of $H_2$ was 30% for all current densities tested.

As illustrated in FIG. 28*h*, maximum ethylene production over a duration of 24 hours was measured with an FE value of 35% at a constant current density of 200 mA/cm$^2$. After 17 hours, a slight decrease in ethylene selectivity was noted, with attainment of an FE value for ethylene of 33% after 24 hours. This experiment shows the prolonged stability of $Cu_4O_3$ in ethylene production.

Example 2 ($Ag_2Cu_2O_3$)

The synthesis of $Ag_2Cu_2O_3$ was based on the synthesis method published in the publication Inorganic Chemistry, vol. 41, no. 25, 2002.

Figure 29:
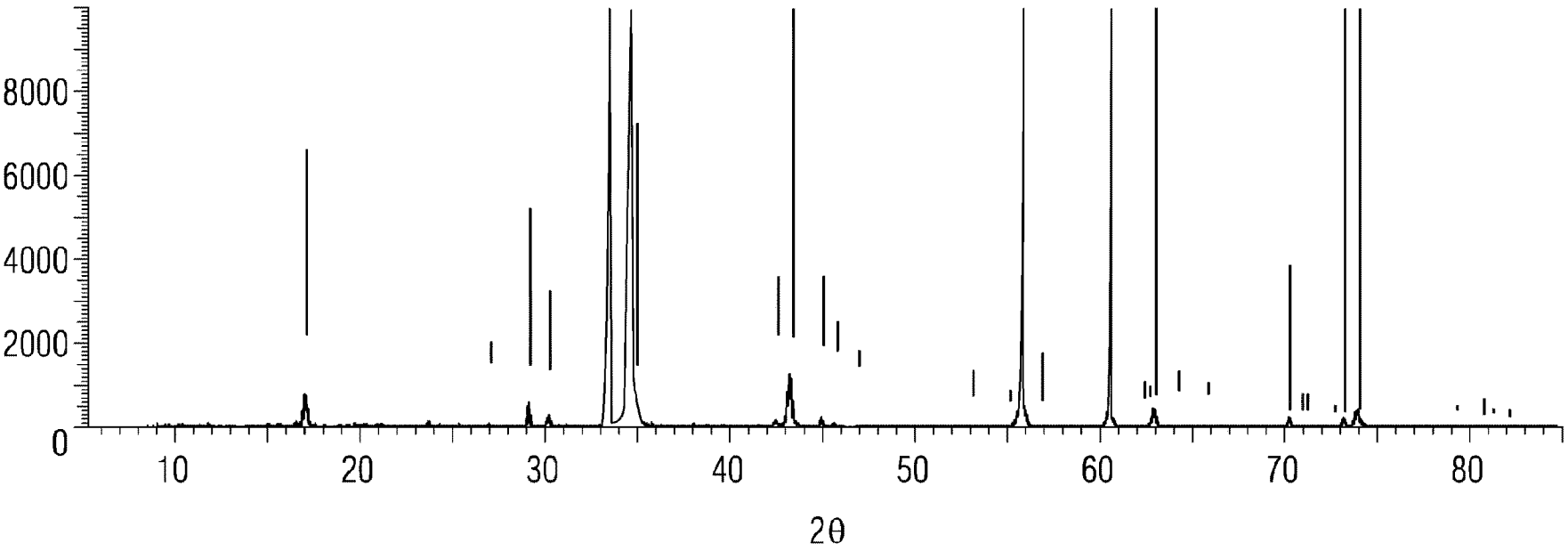
FIGS. 29 and 30 an x-ray powder diffractogram and an SEM image of example 2.
Figure 30:
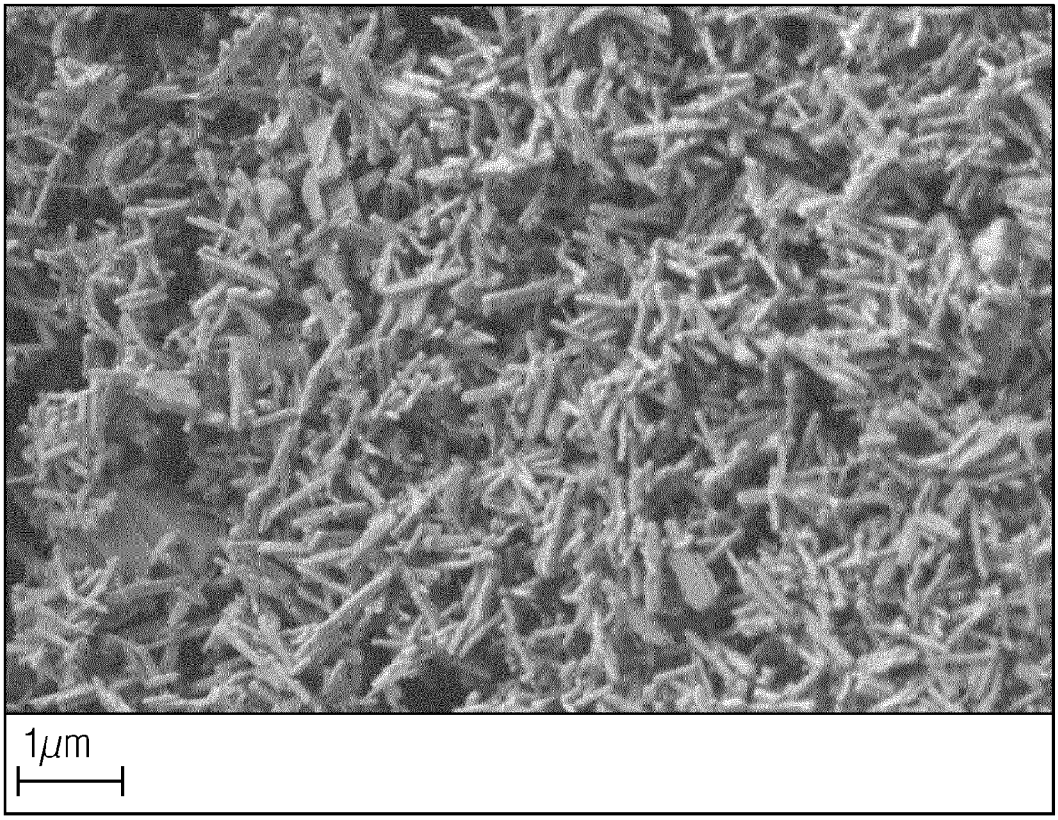

A 50 mL three-neck round bottom flask with magnetic stirrer and argon atmosphere was initially charged with 4 mL of a 4M NaOH, and 2 mL of a salt solution of $Cu(NO_3)_2$*$3H_2O$ (0.77 g, 3.2 mmol) (Merck, p.a. 99.5%) and $AgNO_3$ (0.52 g, 3.1 mmol) (Panreac, p.a., 99.98%) were added with vigorous stirring. After the addition, an olive green precipitate formed, which consisted of amorphous $Cu(OH)_2$ and $Ag_2O$. The mixture was stirred at room temperature for six hours, and 40 mL of deionized water was added after two hours. There was a color change from olive green to black, which was caused by the formation of $Ag_2Cu_2O_3$. After six hours, the black precipitate was filtered off and washed to neutrality by means of a suction filter. The black $Ag_2Cu_2O_3$ is isotypic with paramelaconite $Cu_4O_3$. Detection of the compound and detection of the phase purity of the $Ag_2Cu_2O_3$ produced were effected by PXRD. FIGS. 29 and 30 show the corresponding powder diffractogram (coupled 2 theta/theta, WL=1.54060 angstrom) and an SEM image of the $Ag_2Cu_2O_3$ produced.

Example 2a): Production of an $Ag_2Cu_2O_3$ Gas Diffusion Electrode (GDE) with Cation Exchange Ionomer First of all, a catalyst-binder dispersion was produced. For this purpose, in a snap-lid bottle, a suspension of 60 mg of $Ag_2Cu_2O_3$ catalyst powder with a maximum size of $d_{50}$<5 um in 2 mL of isopropanol was produced. 30 mg of a 20% Nafion dispersion (Nafion DE 2021) was added to the suspension. The mixture was treated in an ultrasound bath with occasional agitation for 15 min.

Subsequently, a gas diffusion layer (GDL) (Freudenberg C2, Sigracet 25BC) having an area of 4 cm×10 cm was coated. For this purpose, the GDL was fixed to the reverse side of a petri dish with Kapton tape. In the case of a stable catalyst-binder suspension, this was applied by brush or with an airbrush. In the case of an unstable suspension, the entire contents of the snap-lid bottle were poured over the GDL and distributed uniformly. After a drying time of about 30 minutes, the operation was repeated. A total of 4 steps were required to produce a catalyst loading of 6 mg/cm$^2$. Finally, drying was effected with an argon gas stream over the course of 12 hours.

Example 2b): Production of an $Ag_2Cu_2O_3$ GDE with Anion Exchange Ionomer

In a 4 mL snap-lid bottle, 60 mg of catalyst powder and 120 mg a 5% dispersion of the ionomer AS4 from Tokuyama as a binder were weighed out and diluted with 2 mL of n-propanol. As an alternative ionomer it is possible to use Sustanion XA9 in ethanol. The mixture was homogenized in an ultrasound bath for 15 min. The dispersion produced was applied to a Freudenberg C2 gas diffusion layer GDL (4 cm×10 cm) and dried in an argon stream, and the operation was repeated three times. The electrode was dried in an argon stream for 12 hours prior to use. The catalyst loading was adjusted to 4.5 mg/cm$^2$.

Example 2c) Production of an $Ag_2Cu_2O_3$ GDE with Anion Exchange Ionomer

A gas diffusion layer (GDL) (Freudenberg C2) that had a microporous carbon black layer and a fiber-based PTFE-bound substrate was used as catalyst support. A catalyst ink was produced by dispersing 90 mg of catalyst powder in 3 mL of 1-propanol. In addition, 25 μL of Sustanion XA-9 ionomer (Dioxide Materials) was added to the catalyst ink. The mixture was then treated in an ultrasound bath for 20 minutes. Thereafter, the GDE was produced by applying the catalyst ink produced to the GDL with an airbrush. After the application, the GDE was dried at room temperature overnight. The GDL was weighed before and after the applying of the catalyst in order to determine the catalyst loading. The catalyst loading was 1.5 mg/cm$^2$ (±0.2). During the spray coating, about 50% by weight of the catalyst material was lost.

Electrochemical Tests of $Ag_2Cu_2O_3$ as Catalyst

The electrochemical performance of the GDE that contained $Ag_2Cu_2O_3$ as catalyst in $CO_2$ reduction and CO reduction was tested in the electrolysis structures described hereinafter.

For $CO_2$ reduction, a stacked three-chamber flow cell (Micro Flow Cell from ElektroCell) was used. The first chamber that was utilized as $CO_2$ gas (supply) chamber was separated from the second chamber by the GDE, which served as cathode. The GDE area that separates the first chamber from the second chamber (also called active geometric surface area here) was about 10 cm$^2$. The second and third chambers respectively contained a catholyte and an anolyte, and were separated by a Nafion 117 membrane (cation exchange membrane). The structure of the stacked three-chamber flow cell corresponds to that as shown schematically in FIG. 26. The electrolytes were pumped through the cell in two separate cycles. The anode space was filled with 2.5 M KOH and had an $IrO_2$-containing anode. For the cathode space, the GDE was used as cathode and 0.5 M $K_2SO_4$ as electrolyte, with a pH range varying around pH 7. All electrolytes were produced with ultrapure water (18.2 MΩ cm, MilliQ Millipore system). The electrolyte flow was controlled using a peristaltic pump (Ismatec ECOLINE VC-MS/CA8-6) that kept the flow constant at 40 mL/min. $CO_2$ gas (Air Liquide, 99.995%) was used without further purification. The gas was introduced continuously into the flow cell (gas (supply) chamber) at atmospheric pressure at a constant flow rate of 100 mL/min. The gas flow was monitored with a mass flow monitoring unit (Bronkhorst). Unconverted $CO_2$ and gas products formed were evacuated from the gas chamber through a gas outlet on the reverse side of the gas chamber. The cell was equipped with an Ag/AgCl/3M KCl reference electrode. The pH of the catholyte was monitored using a pH electrode (Metrohm) during the experiments. The counterelectrode used was a solid Ti plate coated with $IrO_2$ (Ir-MMO, iridium metal mixed oxide) from ElectroCell. All electrochemical measurements were conducted with a Metrohm Autolab PGSTAT302N potentiostat-galvanostat.

For potentiostatic measurements, the cathode was connected as working electrode. Chronoamperometric measurements were also conducted, meaning that the current was kept constant while the potential of the cell and potential of the electrode were monitored over time. These experiments were executed at different current densities (calculated by dividing the total current supplied by the active geometric surface area of the GDE).

For CO reduction, the same electrolysis structure and the same method as for the $CO_2$ reduction were used, with the following differences: —CO was used as gas rather than $CO_2$, −1 M $CSHCO_3$ was used as the catholyte rather than 0.5 M $K_2SO_4$, −1 M $CsHCO_3$ was used as the anolyte rather than 2.5 M KOH, —an anion exchange membrane (Fumatech, FAB-PK-130) was used rather than the cation exchange membrane.

Analysis of Gaseous and Liquid Products

The gaseous products were taken every 15 min using gas sampling bags and analyzed with a Thermo Scientific Trace 1310 gas chromatograph (GC) equipped with two thermal conductivity detector (TCD) channels. In the case of a chronoamperometric extended electrolysis, the product gas from the flow reactor was guided directly to the GC. The hydrocarbons were separated with a GC column packed with micropacking (Shincarbon™, Restek, Bellefonte, PA, USA) with He as carrier gas. Hydrogen was measured on a packed 5 Å molecular sieve column (Restek, Bellefonte, PY, USA) with Ar as carrier gas.

The liquid products were analyzed as follows: once the electrochemical measurements were complete, 1 mL of the catholyte was taken and analyzed by nuclear magnetic resonance in order to detect liquid products. $^1$NMR spectra were recorded on a 400 MHz Bruker Avance 400 spectrometer equipped with a 5 mm Ag$^{31}$P Autotune BBO probe, a pulsed field gradient unit and a gradient control unit. NMR samples were produced as follows: 250 μL of $D_2O$ and 50 μL of an internal standard stock solution with 0.06 M potassium fumarate in water were added to 300 μL of electrolyte.

The Faraday efficiencies (FE) of the liquid and gaseous products were obtained by the following equation:

$$FE = \frac{eFn}{Q} = \frac{eFn}{It}$$

with F as the Faraday constant, I as the current, Q as the charge, e as the number of electrons transferred, t as the electrolysis time, and n as the amount of product in mol.

Potentiostatic $CO_2$ Reduction Experiments Using $Ag_2Cu_2O_3$ as Catalyst

In order to demonstrate activity and selectivity for hydrocarbons, especially for ethylene, an illustrative GDE containing $Ag_2Cu_2O_3$ was tested. The experiments were conducted in potentiostatic electrolysis mode, meaning that the cell potential was kept constant during the experiment. Gaseous products were analyzed with a Thermo Scientific Trace 1310 gas chromatograph.

Figure 31:
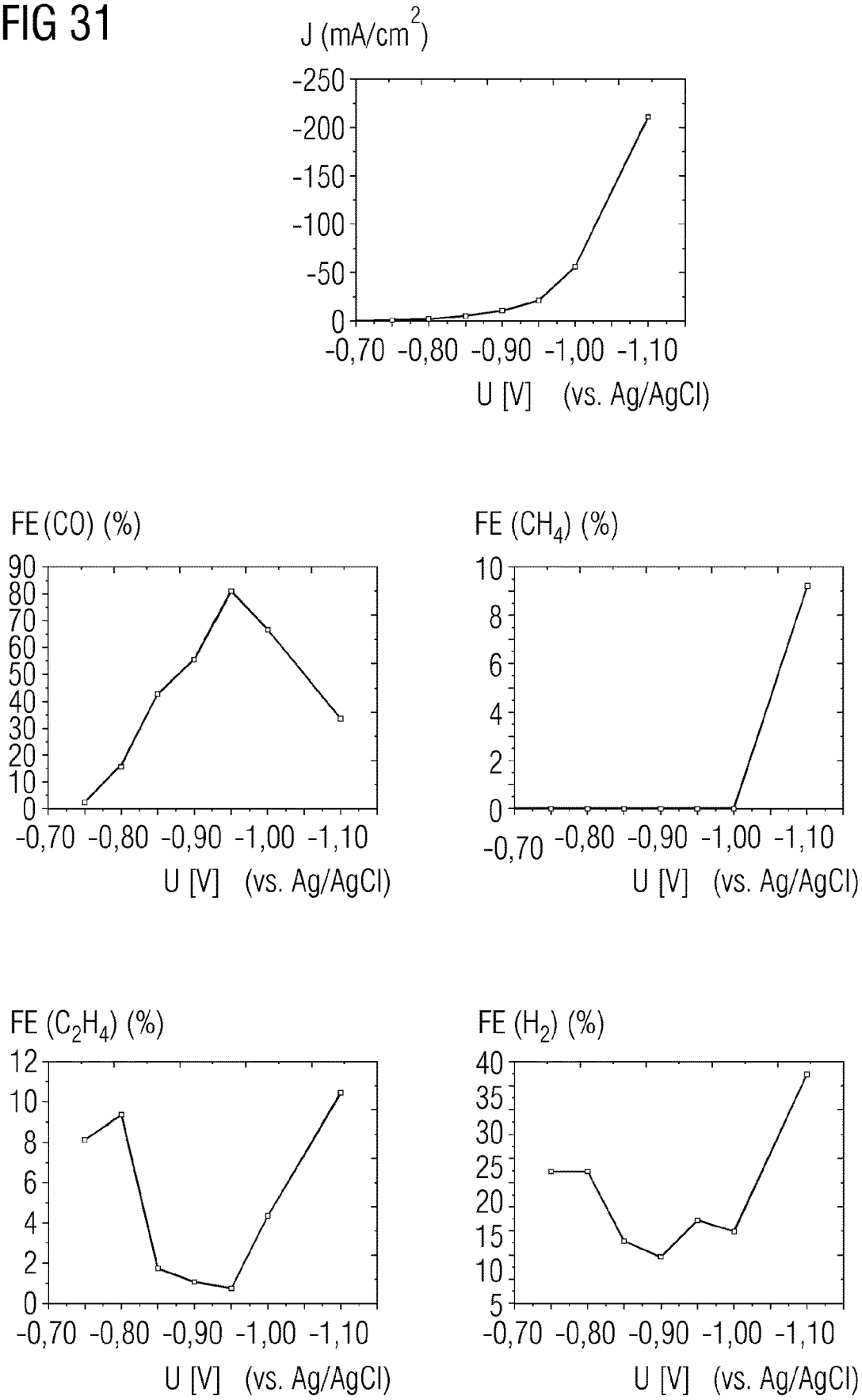
FIGS. 31 and 32 results of electrochemical measurements of example 2.

The results of the electrochemical measurements of $CO_2$ reduction are shown in FIG. 31. The following gas products were monitored: $C_2H_4$, CO, $CH_4$, $C_2H_6$ and $H_2$. As apparent from FIG. 31, CO was found to be the main product at the potentials (U) tested, which had a maximum of more than 80% at −0.95 V vs. Ag/AgCl. On the other hand, the formation of hydrocarbons is reduced at this potential. However, at more negative potentials, the production of CO decreases, and hydrocarbons are increasingly formed (see, for example, the values at −1.1 V vs. Ag/AgCl in FIG. 31), especially ethylene and methane. Product selectivity is thus controllable very efficiently via the potential set.

Chronoamperometric $CO_2$ Reduction Experiments Using $Ag_2Cu_2O_3$ as Catalyst

Results of chronoamperometric measurements for $CO_2$ reduction with an illustrative $Ag_2Cu_2O_3$-containing GDE are shown in FIGS. 33 and 34. FIGS. 33*a* to 33*f* show the results for gas products, while FIGS. 34*a* to 34*e* illustrate the results for liquid products of the $CO_2$ reduction.

Figure 33A:
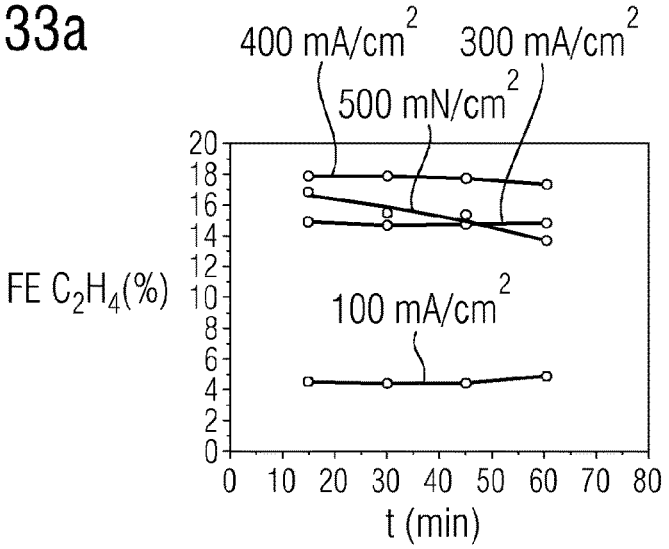
FIGS. 33*a* to 33*f* results of electrochemical measurements for gaseous products of a $CO_2$ reduction with $Ag_2Cu_2O_3$ according to example 2.
Figure 33B:
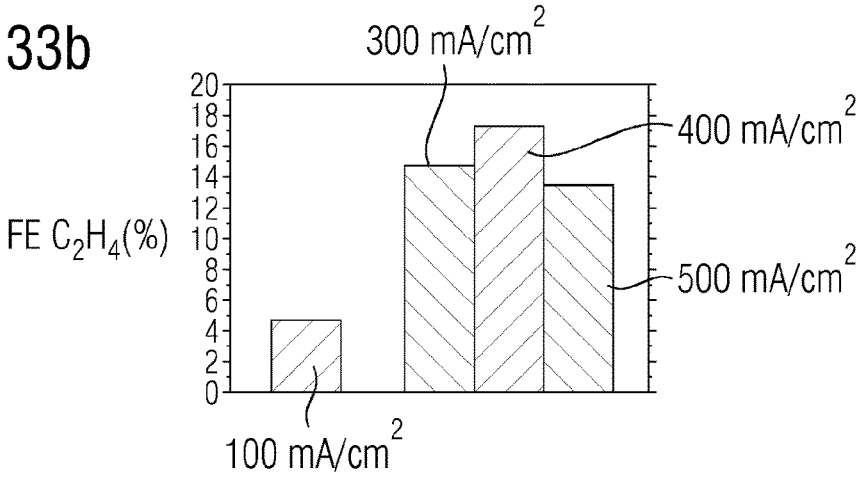
Figure 33C:
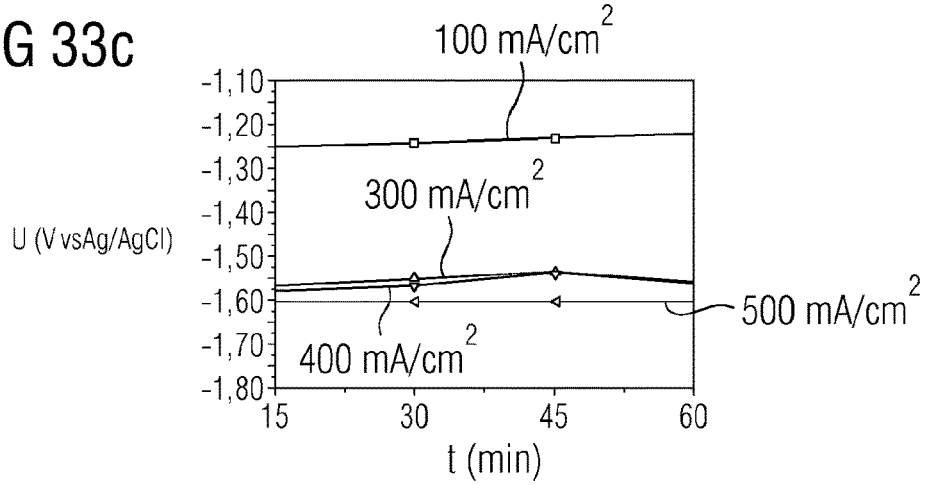

FIGS. 33*a* and 33*b* show more detailed results for the gaseous product $C_2H_4$. Measurements were made at various current densities (J), namely 100, 300, 400 and 500 mA/cm$^2$. At high current densities, it was possible to achieve high Faraday efficiencies (FE) with the GDE. It was found that high Faraday efficiencies result at high current densities, with a maximum Faraday efficiency at 400 mA/cm$^2$ (FIG. 33*a*), even after one hour of electrolysis (1 h; FIG. 33*b*). FIG. 33*c* shows corresponding working potentials (U) as a function of time (t). As is apparent therefrom, the respective working potentials at the current densities chosen remained stable over time. The $Ag_2Cu_2O_3$ present in the GDE thus brings about high Faraday efficiencies at high current densities for the reduction of $CO_2$ to ethylene and additionally has prolonged stability.

Figure 33D:
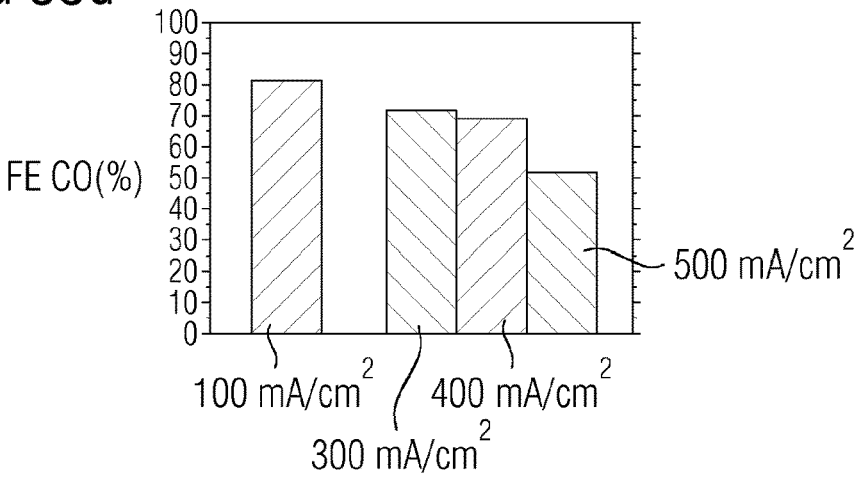
Figure 33E:
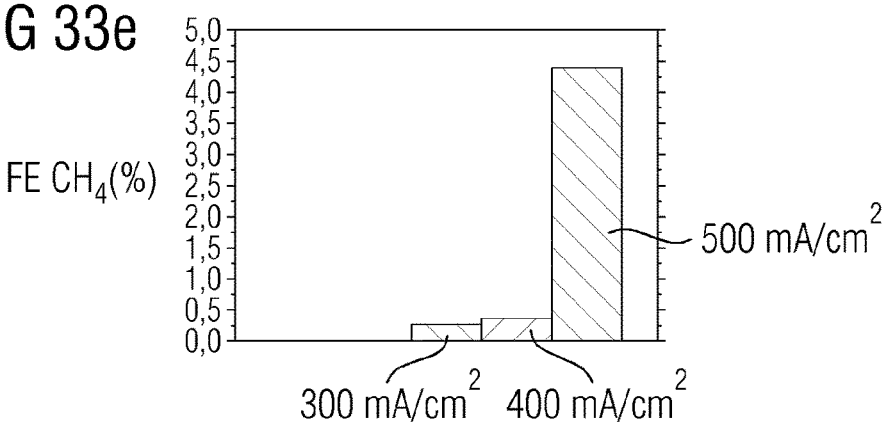
Figure 33F:
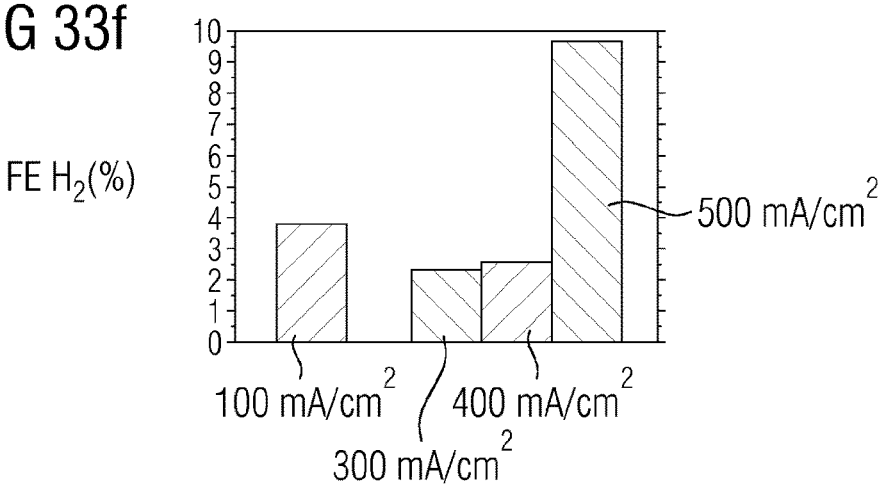

For the gas products CO, $CH_4$ and $H_2$, the electrochemical measurements are shown in FIGS. 33*d* to 33*f*. The Faraday efficiencies are shown in each case at different current densities, namely 100, 300, 400 and 500 mA/cm$^2$, after one hour of operation of the GDE. For the products $CH_4$ and $H_2$, an increase in the Faraday efficiencies is detected in each case with rising current densities, whereas a decrease in Faraday efficiency occurs for CO with rising current density. For $CH_4$ and $H_2$, therefore, an increase in the selectivity of the $Ag_2Cu_2O_3$-containing GDE is apparent with rising current density.

FIGS. 34*a* to 34*e* show the electrochemical measurements for the liquid products formate (34*a*), acetate (34*b*), allyl alcohol (34*c*), ethanol (34*d*) and n-propanol (34*e*) after one hour of electrolysis. Traces of methanol and acetone were also detected. As is clearly apparent, for the formate, acetate, allyl alcohol and ethanol products, the Faraday efficiencies increased with rising current densities of 100, 300, 400 and 500 mA/cm$^2$. n-Propanol, by contrast, showed FE maxima both at 100 mA/cm$^2$ and at 500 mA/cm$^2$, but likewise showed a trend of rising Faraday efficiency with rising current density over and above 300 mA/cm$^2$. An increase in the selectivity of the $Ag_2Cu_2O_3$-containing GDE with rising current density is therefore also apparent for the liquid hydrocarbon products monitored in the $CO_2$ reduction.

Figure 34A:
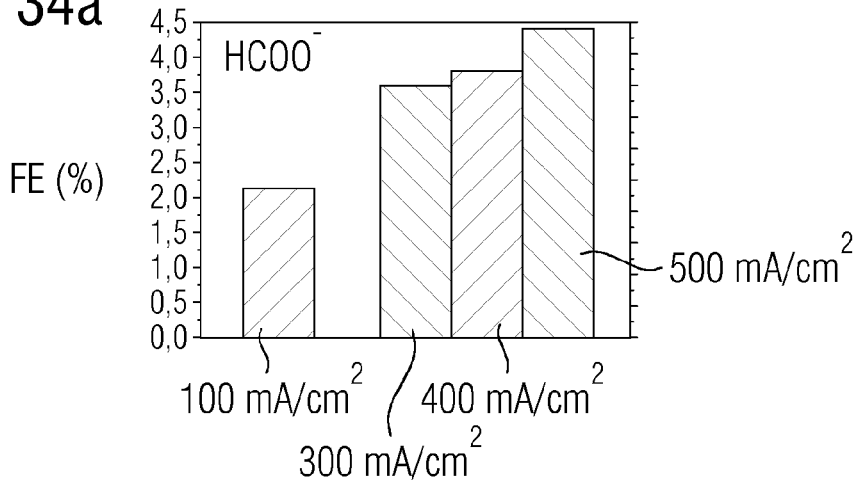
FIGS. 34*a* to 34*e* results of electrochemical measurements for liquid products of a $CO_2$ reduction with $Ag_2Cu_2O_3$ according to example 2.
Figure 34B:
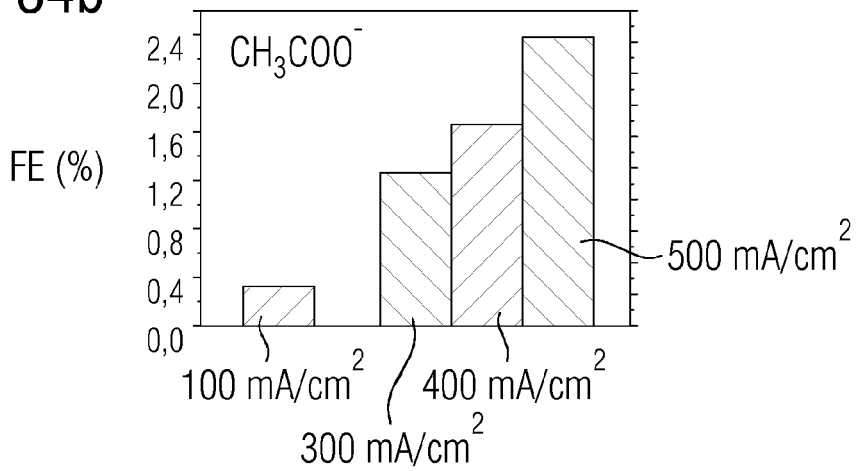
Figure 34C:
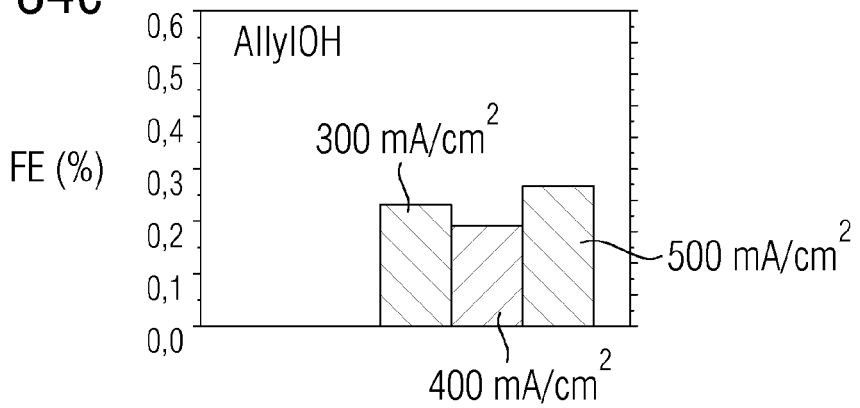
Figure 34D:
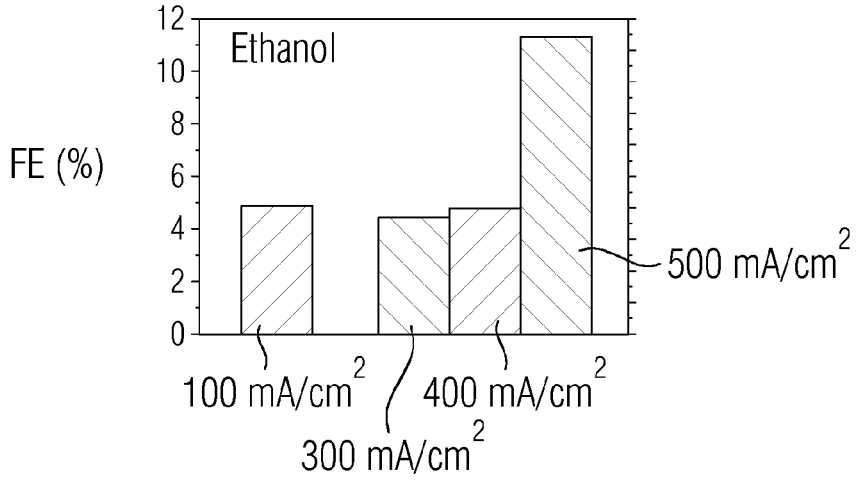
Figure 34E:
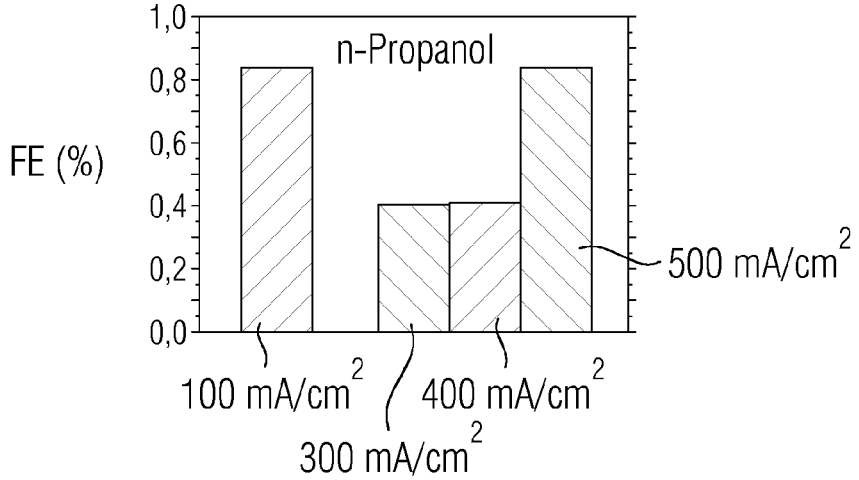

In view of the data in FIGS. 33*a* to 33*f* and 34*a* to 34*e*, it is apparent that CO is the main product (maximum FE of 80% at 100 mA/cm$^2$) of the $CO_2$ reduction using $Ag_2Cu_2O_3$ as catalyst. It has been observed that the selectivity for CO drops with rising current density (FIG. 33*d*). As well as CO, three further gas products were detected: ethylene, methane and hydrogen. Ethylene reached a maximum FE of 17% at 400 mA/cm$^2$ (FIG. 33*b*) and hence represents the second main product. At higher current densities, the FE for ethylene began to drop. Methane was detected only at current densities greater than 300 mA/cm$^2$, with a maximum FE of 4.5% at 500 mA/cm$^2$ (FIG. 33*e*). On the other hand, five different liquid products were detected: ethanol, n-propanol, acetate, formate and allyl alcohol. Also measured were traces of methanol and acetone (FE<0.05%). After CO and ethylene, ethanol thus represents the third main product in the $CO_2$ reduction, with a maximum FE of 11% (FIG. 34*d*). The FE for the other alcohol, namely n-propanol, was below 1% for all current densities tested (FIG. 34*e*). The formation of formate and acetate increased with rising current densities, with a maximum FE of 4.4% and 2.4% respectively. Allyl alcohol was detected in traces (FIG. 34*c*).

Comparative $CO_2$ Reduction Experiments Using Ag and $Ag_2Cu_2O_3$ as Catalysts Comparative experiments were conducted on a GDE with Ag as catalyst, i.e. containing solely Ag as catalytically active metal, and on the GDE used for the measurements of FIG. 31 with $Ag_2Cu_2O_3$ as catalyst. The respective experimental setup corresponded to that of the above-specified electrochemical measurements for the $Ag_2Cu_2O_3$ GDE. The Ag GDE was produced analogously to the $Ag_2Cu_2O_3$ GDE, using Ag nanoparticles (50-60 nm, 99.9%, iolitec).

Figure 32:
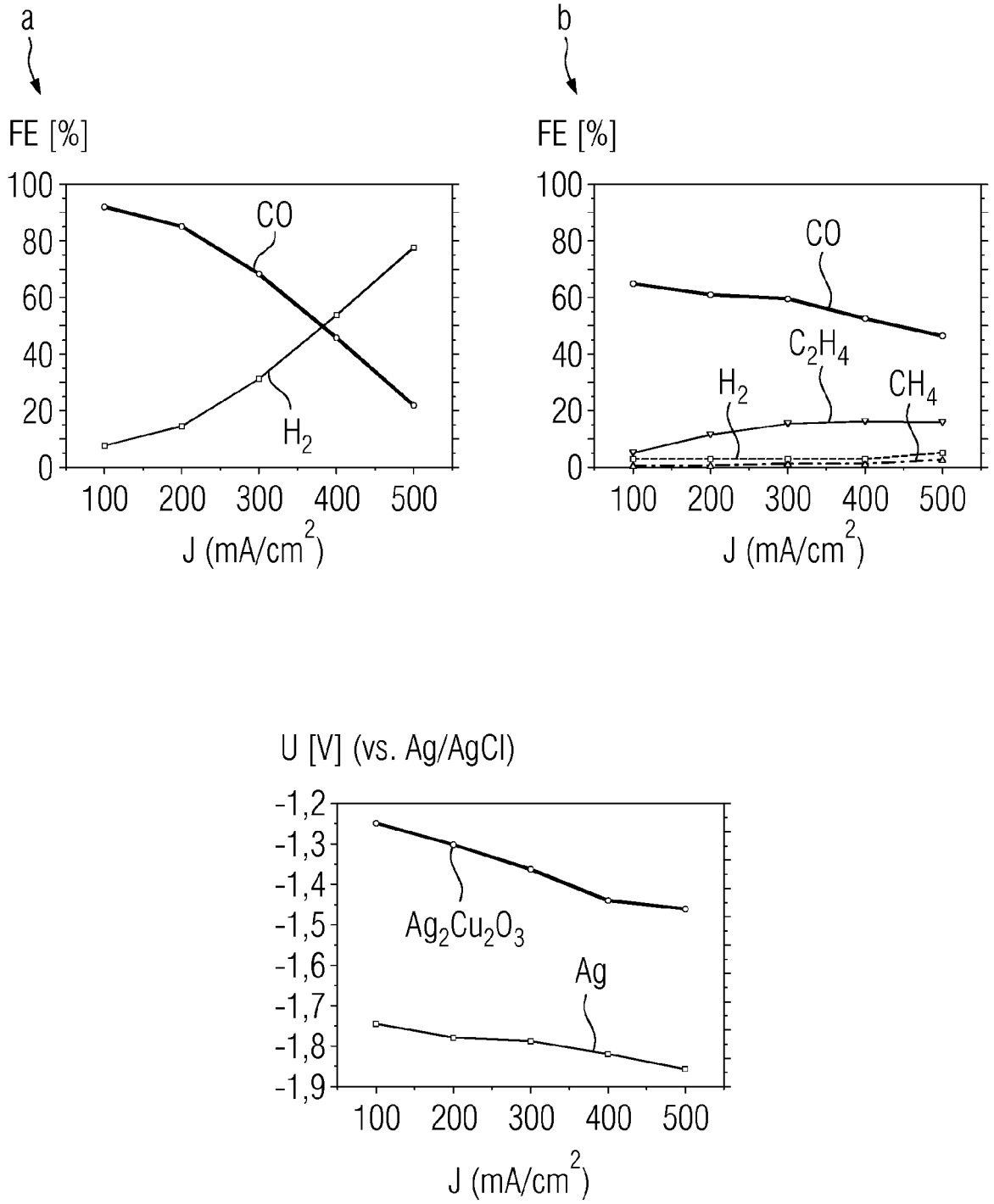

The Faraday efficiencies (FE) and working potentials (U) of the two GDEs were ascertained as a function of current density. The corresponding results are shown in FIG. 32. Diagrams a and b of FIG. 32 show the Faraday efficiencies at different current densities. Diagram a shows the FE results for the Ag catalyst, while diagram b shows those for the $Ag_2Cu_2O_3$ catalyst. It is clearly apparent that CO is the only carbon-containing gas product when Ag is used as catalyst for $CO_2$ reduction. The Ag catalyst gave high Faraday efficiencies for CO at low current densities. With rising current density, there was a drop in the Faraday efficiencies for CO, while there was a rise in hydrogen evolution (HER hydrogen evolution reaction). HER is a side reaction in $CO_2$ electroreduction that should be suppressed as far as possible. As apparent from diagram b, by contrast with the Ag catalyst, the $Ag_2Cu_2O_3$ catalyst is capable of reducing $CO_2$ to valuable hydrocarbons such as methane ($CH_4$) and ethylene ($C_2H_4$). The main gas evolved is still CO, but—as apparent from diagram b of FIG. 32—the selectivity for CO decreases with rising current density. This decrease can be interpreted as an elevated selectivity for ethylene with rising current density. CO is a precursor for ethylene formation during $CO_2$ reduction, such that, at higher current densities, CO is utilized more efficiently for the production of ethylene. In addition, interestingly, hydrogen evolution HER is greatly reduced when $Ag_2Cu_2O_3$ is used as electrocatalyst. At all the current densities tested, the Faraday efficiency of the unwanted HER was below 5%.

The diagram of FIG. 32, which shows the working potentials of the cathode as a function of current density, also shows clearly that the $Ag_2Cu_2O_3$ catalyst works at considerably lower potentials than the Ag catalyst. This is important in relation to economic aspects. This is because it enables operation of the $CO_2$ electrolysis systems at much lower overall voltages, which reduces the energy costs for the use of the electrolysis systems.

Chronoamperometric CO Reduction Experiments Using $Ag_2Cu_2O_3$ as Catalyst

Figure 35A:
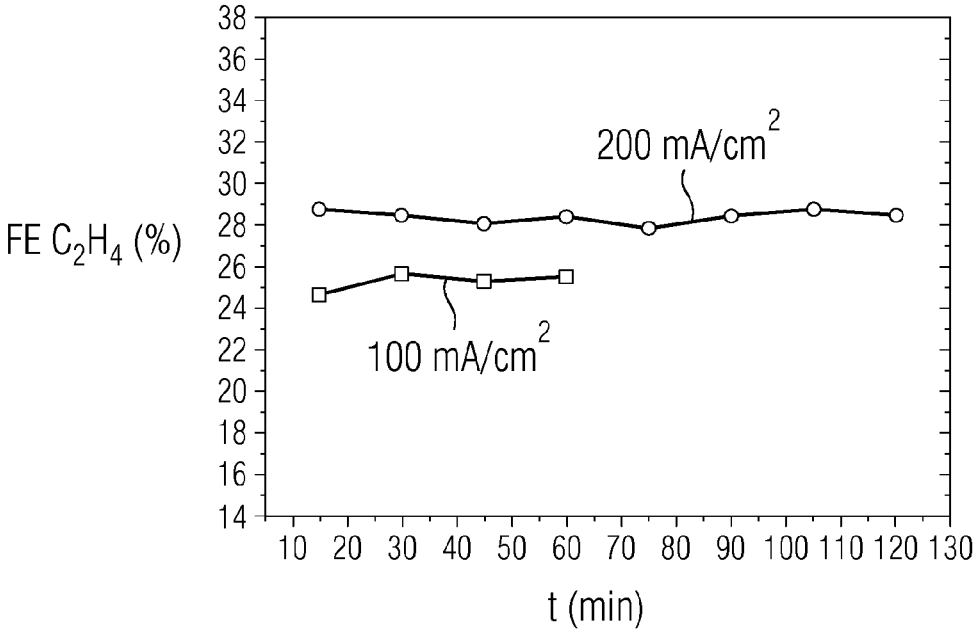
FIGS. 35*a* and 35*b* Faraday efficiencies (FE) for the gaseous ethylene and hydrogen products of a CO reduction with $Ag_2Cu_2O_3$ according to example 2.
Figure 35B:
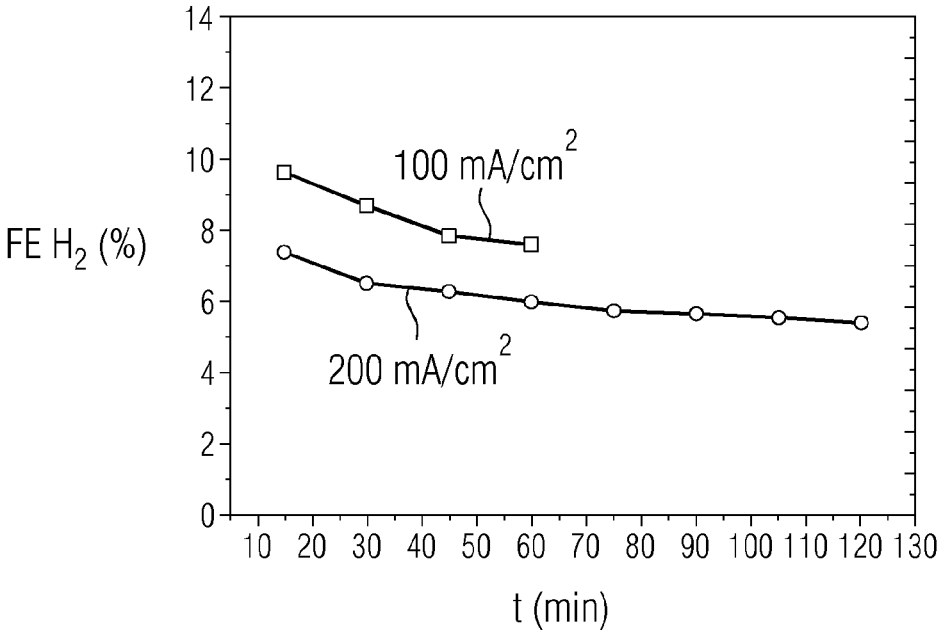

The results of chronoamperometric measurements of CO reduction with an illustrative GDE are shown in FIGS. 35*a* and 35*b*. The following gaseous or liquid products were monitored: ethylene ($C_2H_4$), methane ($CH_4$), ethanol (EtOH), acetate ($CH_3COO^-$), n-propanol, acetone, allyl alcohol (AllylOH, AlOH), methanol (MeOH) and hydrogen ($H_2$).

FIGS. 35*a* and 35*b* show the Faraday efficiencies (FE) at current densities of 100 mA/cm$^2$ and 200 mA/cm$^2$ as a function of time (t) for the gaseous ethylene and hydrogen products. Methane was detected in traces. The Faraday efficiencies for ethylene are in the range between 24% and 29%, whereas, for $H_2$, only Faraday efficiencies between 5% and 10% were detected. Over a period of 120 min, the Faraday efficiencies for ethylene remained stable at the current densities tested.

After one hour (1 h) of electrolysis, at current densities of 100 mA/cm$^2$ and 200 mA/cm$^2$, the following proportions of liquid products were ascertained using the Faraday efficiencies (methanol was found merely in traces):

| | Ethanol | Acetate | AlOH | n-Propanol | Acetone |
|---|---|---|---|---|---|
| 100 mA/cm$^2$ | 39.05% | 16.86% | 2.12% | 6.92% | 0.34% |
| 200 mA/cm$^2$ | 40.92% | 15.49% | 1.99% | 6.23% | 0.30% |

It was found that the formation of hydrogen, methane (<0.5%) and methanol is suppressed or reduced. This enables achievement of Faraday efficiencies of more than 90% at 100 mA/cm$^2$ or more than 93% at 200 mA/cm$^2$ for $C_{2+}$ products, i.e. products having two or more carbon atoms.

FIGS. 35*a* and 35*b* and the table given above illustrate the results when CO rather than $CO_2$ was used as gas in electrolysis with the $Ag_2Cu_2O_3$ GDE. This resulted in three gas products: ethylene, hydrogen and traces of methane (<0.5% FE). It is apparent from FIG. 35*a* that the FE for ethylene remained stable over the period for the two current densities, which demonstrates the stable catalytic performance of $Ag_2Cu_2O_3$. With rising current density, there was also a rise in the FE for ethylene. On the other hand, there was a decrease in the FE for hydrogen with rising current density, and also over time (FIG. 35*b*). Six different compounds were detected as liquid products: ethanol, n-propanol, acetate, acetone, allyl alcohol and traces of methanol (table above). It was found that the calculated FEs for liquid products did not result in any great difference at the two different current densities. A common factor to the two current densities tested is that ethanol is the main product, followed by ethylene and acetate.

The results for CO reduction using the $Ag_2Cu_2O_3$-containing GDE therefore demonstrate that $Ag_2Cu_2O_3$ is a highly active electrocatalyst which is selective for hydrocarbon products and/or oxygenate products and has prolonged stability not just for the reduction of $CO_2$ but also for the reduction of CO.

Under aqueous conditions, known catalysts for $CO_2$ and CO reduction (e.g. copper-based catalysts) produce a mixture of $C_1$ reduction products (i.e. products having only one carbon atom) and $C_{2+}$ reduction products (i.e. products having two or more carbon atoms). $C_2$+ hydrocarbon and oxygenate products are more desirable compared to $C_1$ products. In the case of the $C_{2+}$ products, the reason for this is their higher energy densities, ease of storage and ease of transport as liquids (especially in the case of alcohols). For this reason, it is highly important to tailor the selectivity of catalysts in the direction of longer and energetically denser molecules, which opens up opportunities for the production of renewable fuels from CO and $CO_2$. With $Ag_2Cu_2O_3$ as catalyst for CO reduction, the formation of unwanted $C_1$ products and of hydrogen was suppressed or reduced, and $C_{2+}$ products were produced with Faraday efficiencies of more than 90% at 100 mA/cm$^2$ and more than 93% at 200 mA/cm$^2$ (measured after one hour from the start of the experiment).

The invention claimed is:

1. An electrode comprising:

a gas diffusion layer comprising a catalyst, the catalyst comprising a plurality of different tetragonally crystallized compounds, wherein each of the plurality of different tetragonally crystallized compounds comprises at least one element selected from Cu and Ag, wherein the crystal lattice of each of the plurality of different tetragonally crystallized compounds belongs to the $I4_1$/amd space group, wherein each of the plurality of different compounds is selected from $Cu_4O_3$ and a compound isomorphous with $Cu_4O_3$ that is selected from $Ag_{0.58}CeSi_{1.42}$, $Ag_{0.28}Si_{1.72}Yb$, $Cu_{1.035}TeI$, $C_4H_4CuN_6$, $Ag_{0.7}CeSi_{1.3}$, $Ag_8O_4S_2Si$, $Ag_3CuS_2$, CuTeCl, $Ba_2Cs_2Cu_3F_{12}$, $Ag_{0.3}CeSi_{1.7}$, $Ag_6O_8SSi$, $BaCuInF_7$, $Cu_{0.99}TeBr$, $BaCu_2O_2$, $Cu_{16}O_{14.15}$, $YBa_2Cu_3O_6$ and $C_9Ag_9Cl_6Cs_5N_8$.

2. The electrode as claimed in claim 1, wherein the catalyst is present in an amount of 0.1-100% by weight, based on the electrode or on a region of the electrode; and/or wherein the catalyst has been applied to a support.

3. An electrolysis cell comprising:

an electrode as claimed in claim 1.

4. The electrode as claimed in claim 2, wherein the catalyst is present in an amount of 40-100% by weight based on the electrode or on a region of the electrode.

5. The electrode as claimed in claim 2, wherein the catalyst is present in an amount of 70-100% by weight, based on the electrode or on a region of the electrode.

6. The electrode as claimed in claim 1, wherein the catalyst comprises a plurality of particles, the plurality of particles comprising the plurality of different tetragonally crystallized compounds and at least one additive, wherein the particles have a size of from 0.01 to 100 μm, wherein the at least one additive comprises a metal, and wherein the particles have an electrical conductivity of greater than $10^3$ S/m.

7. A process for producing an electrode as claimed in claim 1, comprising:

providing a plurality of tetragonally crystallized compounds containing at least one element selected from Cu and Ag, wherein the crystal lattice of the compounds belongs to the $I4_1$/amd space group; and further comprising a step selected from:

applying the compounds to a support;

and forming the compound to an electrode.

8. The process as claimed in claim 7, wherein the step of applying the compounds to the support is selected from applying a mixture or powder comprising the compounds to the support and dry rolling the mixture or powder onto the support;

applying a dispersion comprising the compounds to the support; and contacting the support with a gas phase comprising the compounds, and applying the compounds to the support from the gas phase.

9. The process as claimed in claim 8, wherein the compounds are applied with a mass coverage of at least 0.5 mg/cm$^2$; and/or wherein the rolling application is effected at a temperature of 25-100° C.

10. The process as claimed in claim 7, wherein the support is a gas diffusion electrode, a support of a gas diffusion electrode, or a gas diffusion layer.

11. The process as claimed in claim 7, wherein the step of forming the compounds to an electrode comprises rolling of a powder comprising the compounds to give the electrode.

12. The process as claimed in claim 7, wherein the electrode is produced in such a way that the compounds are present in an amount of 0.1-100% by weight, based on the electrode or on a region of the electrode; and/or wherein the compounds are provided and applied or formed in a mixture comprising at least one binder.

13. The process as claimed in claim 12, wherein the at least one binder is present in the mixture in an amount of >0% to 30% by weight, based on the total weight of the compounds and the at least one binder.

14. A process for electrochemical conversion of $CO_2$ and/or CO, wherein $CO_2$ and/or CO is introduced into an electrolysis cell comprising an electrode as claimed in claim 1 as a cathode and reduced at the cathode.

15. A process for reduction or electrolysis of $CO_2$ and/or CO, comprising: using the electrode of claim 1.

* * * * *